US010360840B2

(12) United States Patent
Matsueda et al.

(10) Patent No.: US 10,360,840 B2
(45) Date of Patent: Jul. 23, 2019

(54) PIXEL CIRCUIT, DRIVING METHOD THEREOF AND DISPLAY DEVICE

(71) Applicant: NLT Technologies, Ltd., Kanagawa (JP)

(72) Inventors: Yojiro Matsueda, Kanagawa (JP); Yoshihiro Nonaka, Kanagawa (JP); Kenichi Takatori, Kanagawa (JP)

(73) Assignee: NLT TECHNOLOGIES, LTD., Kanagawa (JP)

( * ) Notice: Subject to any disclaimer, the term of this patent is extended or adjusted under 35 U.S.C. 154(b) by 646 days.

(21) Appl. No.: 14/860,998

(22) Filed: Sep. 22, 2015

(65) Prior Publication Data

US 2016/0086545 A1 Mar. 24, 2016

(30) Foreign Application Priority Data

Sep. 22, 2014 (JP) ..... 2014-192644

(51) Int. Cl.
*G09G 3/20* (2006.01)
*G09G 3/3233* (2016.01)
*G09G 3/3291* (2016.01)

(52) U.S. Cl.
CPC ..... *G09G 3/2096* (2013.01); *G09G 3/3233* (2013.01); *G09G 3/3291* (2013.01);
(Continued)

(58) Field of Classification Search
CPC .. G09G 3/2096; G09G 3/3291; G09G 3/3233; G09G 2310/0297;
(Continued)

(56) References Cited

U.S. PATENT DOCUMENTS 6,181,210 B1 * 1/2001 Wakayama ..... H03L 7/0896 327/157
8,947,326 B2 2/2015 Chang et al.
(Continued)

FOREIGN PATENT DOCUMENTS

CN 101206832 A 6/2008
CN 101228569 A 7/2008
(Continued)

OTHER PUBLICATIONS

Chinese Office Action for Application No. 201510609481.0, dated May 23, 2018.
(Continued)

*Primary Examiner* — Aneeta Yodichkas
(74) *Attorney, Agent, or Firm* — Young & Thompson

(57) ABSTRACT

To achieve a pixel circuit and the like capable of improving the accuracy for detecting the threshold voltage. The pixel circuit includes: a light emitting element; a driving transistor which supplies an electric current to the light emitting element according to an applied voltage; a capacitor part which holds a voltage containing a threshold voltage and a data voltage of the driving transistor and applies the voltage to the driving transistor; and a switch part which makes the capacitor part hold the voltage containing the threshold voltage and the data voltage. The switch part includes a reference voltage transistor which inputs a reference voltage from a reference voltage power supply line and a data voltage transistor which inputs a data voltage from a data line.

17 Claims, 12 Drawing Sheets

(52) U.S. Cl.
CPC ..... *G09G 2300/0434* (2013.01); *G09G 2300/0819* (2013.01); *G09G 2300/0852* (2013.01); *G09G 2300/0861* (2013.01); *G09G 2310/0297* (2013.01)

(58) Field of Classification Search
CPC ... G09G 2300/0861; G09G 2300/0852; G09G 2300/0819; G09G 2300/0434
See application file for complete search history.

(56) References Cited

U.S. PATENT DOCUMENTS

| | | | | |
|---|---|---|---|---|
| 2007/0128583 | A1* | 6/2007 | Miyazawa ..... | G09G 3/3233 434/433 |
| 2008/0143653 | A1 | 6/2008 | Shishido | |
| 2010/0156875 | A1 | 6/2010 | Kim et al. | |
| 2013/0043802 | A1 | 2/2013 | Han et al. | |
| 2013/0169611 | A1 | 7/2013 | Chang et al. | |
| 2013/0187554 | A1* | 7/2013 | Ono ..... | G09G 3/3266 315/172 |

FOREIGN PATENT DOCUMENTS

| | | | |
|---|---|---|---|
| CN | 101281739 | A | 10/2008 |
| CN | 101986378 | A | 3/2011 |
| CN | 102314829 | A | 1/2012 |
| CN | 102593151 | A | 7/2012 |
| JP | 2008-203659 | | 9/2008 |
| JP | 2008-287141 | | 11/2008 |
| JP | 2012-014136 | | 1/2012 |
| JP | 2012-108192 | | 6/2012 |
| JP | 2012-128386 | | 7/2012 |

OTHER PUBLICATIONS

Japanese Office Action for Application No. 2014-192644, dated May 15, 2018.
Chinese Office Action for Application No. 201510609481.0, dated Dec. 17, 2018, with English translation provided.
Japanese Office Action for Application No. 2014-192644 dated May 28, 2019 with English translation provided.

* cited by examiner

OUTPUT CHARACTERISTIC OF DRIVING TFT

PIXEL CIRCUIT, DRIVING METHOD THEREOF AND DISPLAY DEVICE

CROSS-REFERENCE TO RELATED APPLICATION

This application is based upon and claims the benefit of priority from Japanese patent application No. 2014-192644, filed on Sep. 22, 2014, the disclosure of which is incorporated herein in its entirety by reference.

BACKGROUND OF THE INVENTION

1. Field of the Invention

The present invention relates to a pixel circuit used in an Active Matrix Organic Light Emitting Diode display (referred to as "AMOLED Display" hereinafter) and the like, a driving method thereof, and a display device which is provided with the pixel circuit. While an organic light emitting diode is also referred to as an organic EL element, it is referred hereinafter as "OLED (Organic Light Emitting Diode)".

2. Description of the Related Art

There is no standard pixel circuit of AMOLED display, so that each of the companies manufacturing AMOLED display uses their original design pixel circuits. Hereinafter, a basic pixel circuit will be described. FIG. 11A is a circuit diagram showing the basic pixel circuit, FIG. 11B is a waveform chart showing a driving method thereof, and FIG. 11C is a graph showing the output characteristic of a driving TFT (Thin Film Transistor) included in the pixel circuit.

A pixel circuit 900 includes a switch TFT 901, a driving TFT 902, a capacitor 903, and an OLED 904, and it is driven and controlled by a double transistor system. The switch TFT 901 and the driving TFT 902 are both p-channel type FET (Field Effect Transistor). The gate terminal of the switch TFT 901 is connected to a scanning line 905, and the drain terminal of the switch TFT 901 is connected to a data line 906. The gate terminal of the driving TFT 902 is connected to the source terminal of the switch TFT 901, the source terminal of the driving TFT 902 is connected to a power supply line 907 (power supply voltage VDD), and the drain terminal of the driving TFT 902 is connected to the anode terminal of the OLED 904. Further, the capacitor 903 is connected between the gate terminal and the source terminal of the driving TFT 902. A power supply line 908 (power supply voltage VSS) is connected to the cathode terminals of the OLED 904.

When a selection pulse (scan signal Scan) is outputted to the scanning line 905 and the switch TFT 901 is set on with this structure, a data signal Vdata supplied via the data line 906 is written to the capacitor 903 as a voltage value. The retention voltage written to the capacitor 903 is held through one frame period, the conductance of the driving TFT 902 is changed in an analog manner by the retention voltage, and a forward bias current corresponding to a luminous gradation is supplied to the OLED 904.

Through driving the OLED 904 by a constant current in this manner, the light emission luminance of the OLED 904 can be maintained to be constant even when the resistance value of the OLED 904 changes due to deterioration.

In order to compensate variation and fluctuation in the threshold voltage of the transistor that drives the OLED in such type of pixel circuit, there is known a technique for detecting the threshold voltage (see U.S. Unexamined Patent Application Publication 2013/0169611 (Patent Document 1) and Japanese Unexamined Patent Publication 2012-128386

(Patent Document 2), for example). As the threshold voltage detecting technique, following two types are the mainstream. (1) A technique (diode connection type) with which the gate terminal and the drain terminal are connected and an electric current is flown between the drain terminal and the source terminal to automatically bring the gate-source voltage Vgs to be close to the threshold voltage Vth. (2) A technique (source follower type) with which the potential of the gate terminal is fixed and an electric current is flown between the drain terminal and the source terminal to automatically bring the gate-source voltage Vgs to be close to the threshold voltage Vth. The source follower type is advantageous in respect that the threshold voltage Vth can be detected even in a depression type transistor in which an electric current flows even when Vgs=0 V.

However, there are following issues with the existing pixel circuit having the threshold voltage detecting function.

(1) The threshold voltage detection period is limited to one horizontal scanning period, so that the compensation accuracy of the threshold voltage becomes deteriorated when the display resolution becomes higher.

Detection of the threshold voltage is executed in the time where a reference voltage is supplied from a data line within one horizontal scanning period or in the time where a data voltage is supplied from a data line within one horizontal scanning period (see FIG. 4 of Patent Document 1, FIG. 4 of Patent Document 2, for example). Thus, though it is possible to detect the threshold voltage for more than one horizontal scanning period, crosstalk is generated due to an influence of the data voltage to be supplied to the neighboring pixel circuits. Therefore, the period to detect the threshold voltage must be shorter than one horizontal scanning period.

In the meantime, the more the display resolution increases, the shorter one horizontal scanning period becomes. When one horizontal scanning period becomes shorter, the threshold voltage detection period becomes shorter as well. Thus, before the gate-source voltage Vgs reaches the threshold voltage Vth, it is required to complete detection of the threshold voltage. Thereby, detection accuracy of the threshold voltage is deteriorated, so that compensation accuracy of the threshold voltage is worsened as well.

(2) Due to the hysteresis characteristic of the driving transistor, several frames are required to completely change the black image to the white image even though the image data has been already completely re-written from black to while. This phenomenon is generally called image retention. In other words, if an electric current is not flown to the driving transistor for a long time, the hysteresis characteristic of the driving transistor becomes initialized. Thus, even when a white-display Vgs bias determined based on the initialized hysteresis characteristic is applied, the electric current is instantly decreased by the hysteresis characteristic for lighting up so that it is insufficient for providing the original brightness of white display.

In consideration of the above-mentioned circumstances, it is an object of the present invention to achieve a pixel circuit to improve the accuracy for detecting the threshold voltage. In addition, another object of the present invention is to achieve a pixel circuit to avoid image retention.

SUMMARY OF THE INVENTION

The pixel circuit according to an exemplary aspect of the invention includes: a light emitting element; a driving transistor which supplies an electric current according to an applied voltage to the light emitting element; a capacitor part which holds a voltage containing a threshold voltage and a data voltage of the driving transistor and applies the voltage to the driving transistor; and a switch part which makes the capacitor part hold the voltage containing the threshold voltage and the data voltage, wherein the switch part includes a reference voltage transistor which inputs a reference voltage from a reference voltage power supply line and a data voltage transistor which inputs the data voltage from a data line.

As an exemplary advantage according to the invention, a reference voltage transistor for inputting a reference voltage from a reference voltage power supply line is provided separately from a data voltage transistor for inputting a data voltage from a data line. This makes it possible to detect the threshold voltage without using the reference voltage supplied from the data line. Thus, crosstalk is not generated theoretically at the time of detecting the threshold voltage. Therefore, the threshold voltage detection period can be set long enough even when the display resolution becomes higher, so that the accuracy for detecting the threshold voltage can be improved.

BRIEF DESCRIPTION OF THE DRAWINGS

FIGS. 1A and 1B show pixel circuits according to a first exemplary embodiment, in which FIG. 1A is a circuit diagram showing the structure of a pixel circuit according to the first exemplary embodiment, and FIG. 1B is a timing chart showing actions of the pixel circuit according to the first exemplary embodiment;

FIGS. 4A and 4B show actions (driving method) of the pixel circuit according to the first exemplary embodiment, in which FIG. 4A is a circuit diagram in a first period, and FIG. 4B is a timing chart in the first period;

FIGS. 5A and 5B show actions (driving method) of the pixel circuit according to the first exemplary embodiment, in which FIG. 5A is a circuit diagram in a second period, and FIG. 5B is a timing chart in the second period;

FIGS. 6A and 6B show actions (driving method) of the pixel circuit according to the first exemplary embodiment, in which FIG. 6A is a circuit diagram in a third period, and FIG. 6B is a timing chart in the third period;

FIGS. 7A and 7B show actions (driving method) of the pixel circuit according to the first exemplary embodiment, in which FIG. 7A is a circuit diagram in a fourth period, and FIG. 7B is a timing chart in the fourth period;

FIGS. 10A and 10B show display devices according to a third exemplary embodiment, in which FIG. 10A is a circuit diagram showing a part of the display device according to the third exemplary embodiment, and FIG. 10B is a timing chart showing actions of the display device according to the third exemplary embodiment; and FIGS. 11A-11C show basic pixel circuits, in which FIG. 11A is a circuit diagram showing the basic pixel circuit, FIG. 11B is a waveform chart showing a driving method of the basic pixel circuit, and FIG. 11C is a graph showing the output characteristic of a driving TFT (Thin Film Transistor) included in the basic pixel circuit.

DETAILED DESCRIPTION OF THE PREFERRED EMBODIMENTS

Figure 1B:
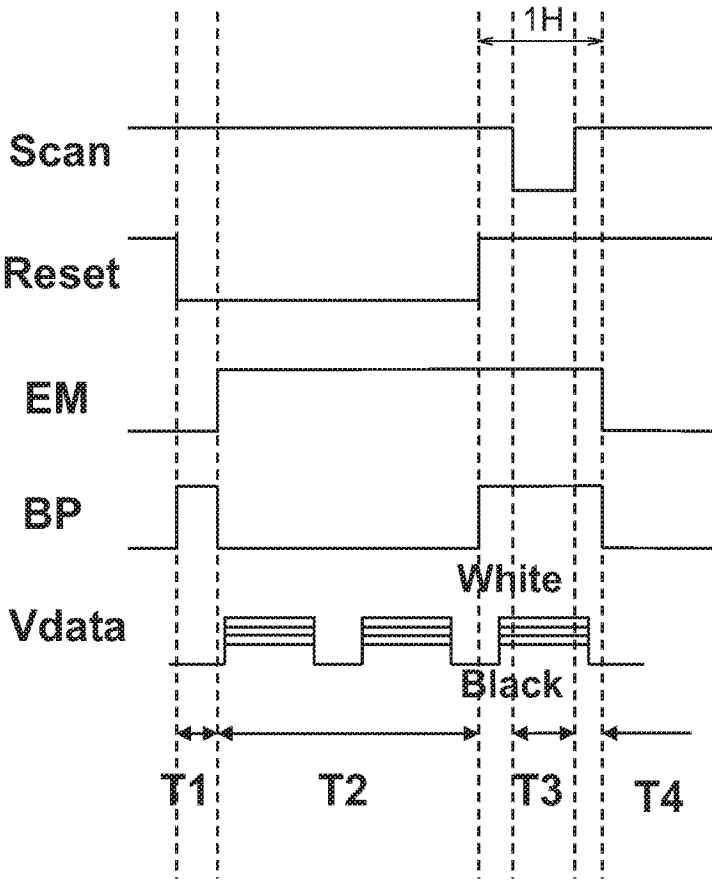

Modes for embodying the present invention (referred to as "exemplary embodiments" hereinafter) will be described hereinafter by referring to the accompanying drawings. In the current Specification and Drawings, same reference numerals are used for substantially same structural elements. Shapes in the drawings are illustrated to be easily comprehended by those skilled in the art, so that dimensions and ratios thereof are not necessarily consistent with the actual ones. "Comprise" in the current Specification and the scope of the appended claims also includes cases having an element other than those depicted therein. "Have", "include", and the like are also the same. "Connect" in the current Specification and the scope of the appended claims means not only a case of connecting two elements directly but also a case of connecting two elements via another element. "Link" and the like are also the same. "On" and "off" of a transistor can also be expressed as "conductive" and "non-conductive", respectively.

(First Exemplary Embodiment)

Figure 1A:
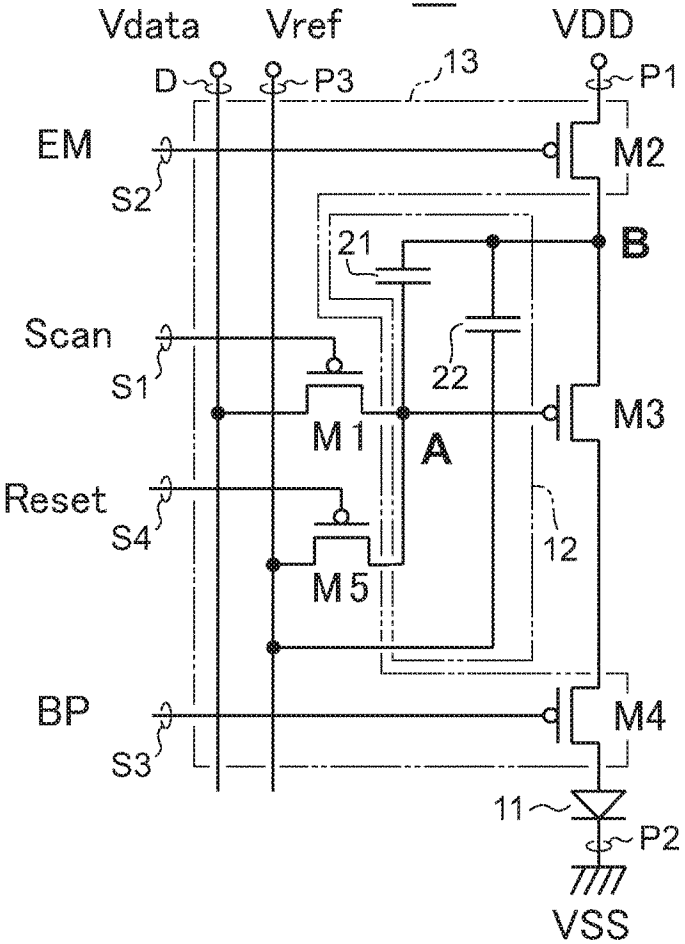

FIG. 1A is a circuit diagram showing the structure of a pixel circuit according to a first exemplary embodiment, and FIG. 1B is a timing chart showing actions of the pixel circuit of the first exemplary embodiment. Explanations will be provided hereinafter by referring to those drawings.

A pixel circuit 10 of the first exemplary embodiment includes: a light emitting element 11; a driving transistor (M3) which supplies an electric current to the light emitting element 11 according to an applied voltage; a capacitor part 12 which holds a voltage containing a threshold voltage Vth and a data voltage Vdata of the driving transistor (M3) and applies the voltage to the driving transistor (M3); and a switch part 13 which makes the capacitor part 12 hold the voltage containing the threshold voltage Vth and the data voltage Vdata. Further, the switch part 13 includes a reference voltage transistor (M5) which inputs a reference voltage (Vref) from a reference voltage power supply line (P3), and a data voltage transistor (M1) which inputs a data voltage Vdata from a data line D.

More specifically, the driving transistor (M3) includes a gate terminal, a source terminal, and a drain terminal, and supplies an electric current according to the voltage applied between the gate terminal and the source terminal to the light emitting element 11 that is connected to the drain terminal The capacitor part 12 holds a voltage containing the threshold voltage Vth and the data voltage Vdata, and applies the voltage between the gate terminal and the source terminal of the driving transistor (M3). The switch part 13 includes a plurality of transistors including the reference voltage transistor (M5) and the data voltage transistor (M1), and makes the capacitor part 12 hold the voltage containing the threshold voltage Vth and makes the capacitor part 12 hold the voltage containing the threshold voltage Vth and the data voltage Vdata thereafter by switching operations of those transistors. Furthermore, the switch part 13 supplies the reference voltage Vref to the capacitor part 12 through turning on the reference voltage transistor (M5) and turning off the data voltage transistor (M1) when making the capacitor part 12 hold the voltage containing the threshold voltage Vth, and supplies the data voltage Vdata to the capacitor part 12 through turning off the reference voltage transistor (M5) and turning on the data voltage transistor (M1) when having the voltage containing the threshold voltage Vth and the data voltage Vdata held to the capacitor part 12.

In the pixel circuit 10 of the first exemplary embodiment, the reference voltage transistor (M5) for inputting the reference voltage Vref from the reference voltage power supply line (P3) is provided separately from the data voltage transistor (M1) for inputting the data voltage Vdata from the data line D. Thereby, it is possible to detect the threshold voltage Vth without using the reference voltage Vref supplied from the data line D. Thus, crosstalk is not generated theoretically at the time of detecting the threshold voltage Vth. Therefore, the threshold voltage detection period can be set long enough even when the display resolution becomes higher, so that the accuracy for detecting the threshold voltage Vth can be improved.

Further, the switch part 13 may supply the reference voltage Vref to the capacitor part 12 through turning on the reference voltage transistor (M5) and turning off the data voltage transistor (M1) over a time equal to or longer than one horizontal scanning period when making the capacitor part 12 hold the voltage containing the threshold voltage Vth. In that case, the threshold voltage detection period can be set still more sufficiently so that the accuracy for detecting the threshold voltage Vth can be improved further. The reference voltage transistor (M5) may be kept on and the data voltage transistor (M1) may be kept off as long as possible within one horizontal scanning period.

Further, the switch part 13 may turn on the driving transistor (M3) temporarily through supplying the reference voltage Vref to the capacitor part 12 when making the capacitor part 12 hold the voltage containing the threshold voltage Vth. In that case, image retention can be suppressed through having a small electric current flown to the driving transistor (M3) every time before driving the light emitting element 11.

Next, the pixel circuit 10 will be described in more details.

The pixel circuit 10 is electrically connected to the data line D, first to fourth control lines S1 to S4, and first to third power supply lines P1 to P3, and includes first to fifth transistors M1 to M5, first and second capacitors 21, 22, and the light emitting element 11. The third power supply line P3 corresponds to the above-described reference voltage power supply line (P3). The first, second, fourth, and fifth transistors M1, M2, M4, and M5 constitute the above-described switch part 13. The first transistor M1 corresponds to the above-described data voltage transistor (M1), the fifth transistor M5 corresponds to the above-described reference voltage transistor (M5), the third transistor M3 corresponds to the above-described driving transistor (M3), and the first and second capacitors 21 and 22 constitute the above-described capacitor part 12.

The first transistor M1 includes: a first terminal that is electrically connected to the data line D; a second terminal; and a control terminal that is electrically connected to the first control line S1. The second transistor M2 includes: a first terminal that is electrically connected to the first power supply line P1; a second terminal; and a control terminal that is electrically connected to the second control line S2.

The third transistor M3 is electrically connected to the second terminal of the second transistor M2, and includes: a first terminal which corresponds to the source terminal of the above-described driving transistor (M3); a second terminal which corresponds to the drain terminal of the driving transistor (M3); and a control terminal which is electrically connected to the second terminal of the first transistor M1 and corresponds to the gate terminal of the driving transistor (M3).

The fourth transistor M4 includes: a first terminal that is electrically connected to the second terminal of the third transistor M3; a second terminal; and a control terminal that is electrically connected to the third control line S3.

The fifth transistor M5 includes: a first terminal that is electrically connected to the third power supply line P3; a second terminal that is electrically connected to the second terminal of the first transistor M1; and a control terminal that is electrically connected to the fourth control line S4.

The first capacitor 21 includes a first terminal that is electrically connected to the second terminal of the first transistor M1, and a second terminal that is electrically connected to the first terminal of the third transistor M3.

The second capacitor 22 includes a first terminal that is electrically connected to the third power supply line P3, and a second terminal that is electrically connected to the first terminal of the third transistor M3.

The light emitting element 11 includes a first terminal that is electrically connected to the second terminal of the fourth transistor M4, and a second terminal that is electrically connected to the second power supply line P2.

Now, the first control line S1 outputs a first control signal Scan, the second control line S2 outputs a second control signal EM, the third control line S3 outputs a third control signal BP, and the fourth control line S4 outputs a fourth control signal Reset. In each transistor, the first terminal is one of the source terminal and the drain terminal, for example. The second terminal is the other one of the source terminal and the drain terminal, for example. The control terminal is the gate terminal, for example. The first terminal of the light emitting element 11 is one of the anode terminal and the cathode terminal (e.g., the anode terminal in the first exemplary embodiment), and the second terminal of the light emitting element 11 is the other one of the anode terminal and the cathode terminal (e.g., the cathode terminal in the first exemplary embodiment).

Further, the first transistor M1 is structured to selectively supply the data voltage Vdata that is supplied from the data line D to the first terminal of the first capacitor 21. The second transistor M2 is structured to selectively supply the first power supply voltage VDD that is supplied from the first power supply line P1 to the first terminal of the third transistor M3, the second terminal of the first capacitor 21, and the second terminal of the second capacitor 22. The third transistor M3 is structured to selectively connect the second terminal of the first capacitor 21 and the second terminal of the second capacitor 22 to the first terminal of the fourth transistor M4. The fourth transistor M4 is structured to selectively connect the second terminal of the third transistor M3 to the first terminal of the light emitting element 11. The fifth transistor M5 is structured to selectively supply the third power supply voltage Vref which is supplied from the third power supply line P3 and corresponds to the above-described reference voltage Vref to the first terminal of the first capacitor 21. The second power supply line P2 supplies the second power supply voltage VSS that is a grounding potential, for example, to the second terminal of the light emitting element 11.

The first to fifth transistors M1 to M5 are p-channel type transistors. More specifically, those are p-channel type TFTs. The light emitting element 11 is OLED. In general, the substrate side (VSS side) is the cathode in the OLED. Thus, for connecting its anode to the drain of the driving transistor, the driving transistor needs to be a p-channel type. Thereby, a constant current can be supplied to the OLED at all times even when the resistance value of the OLED changes as the time passes.

The first, second, fourth, and fifth transistors M1, M2, M4, and M5 constituting the switch part 13 are the switch transistors operated in a linear region. The third transistor M3 is an amplifying transistor operated in a saturated region.

Figure 2:
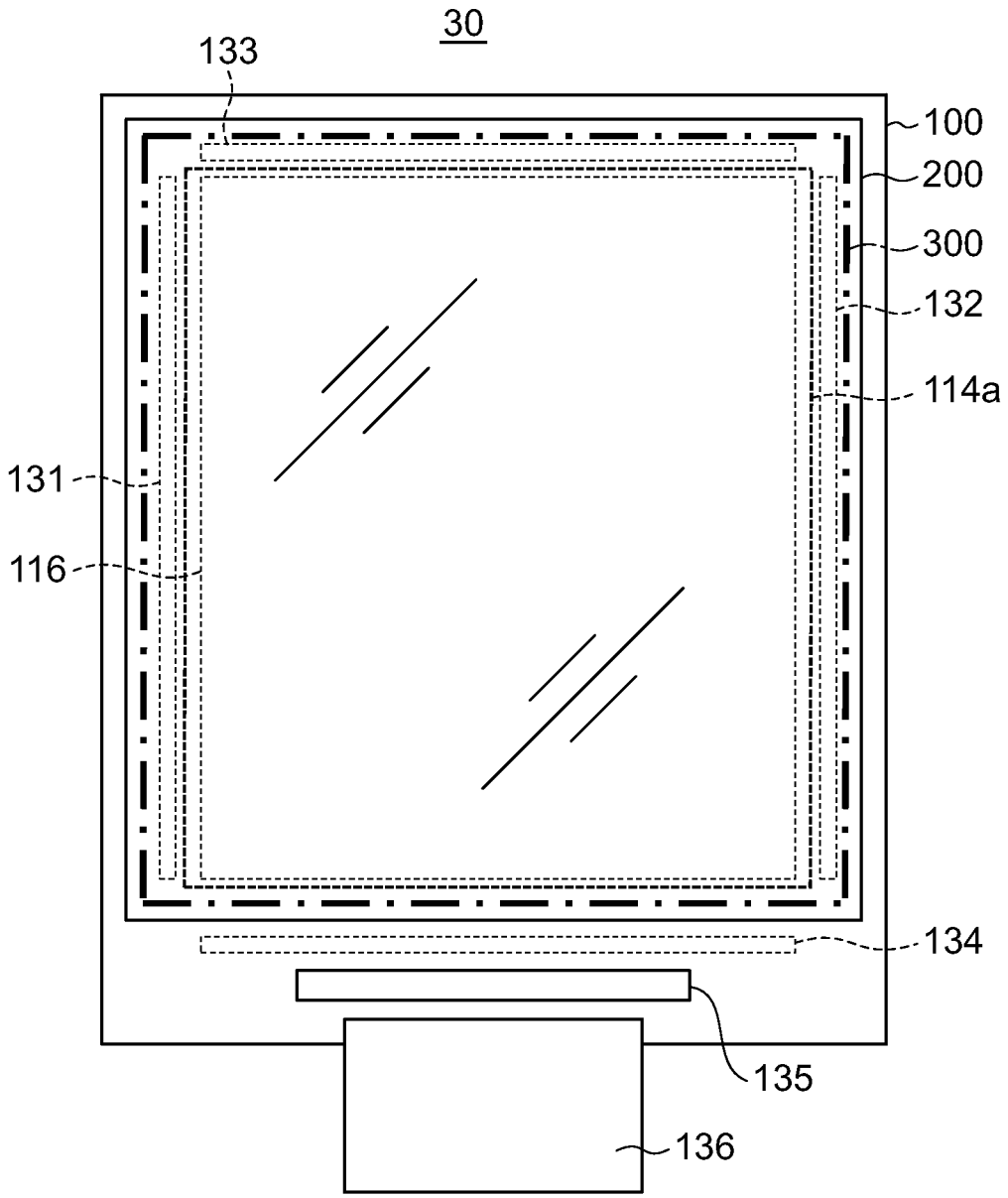
FIG. 2 is a plan view showing a display device that is provided with the pixel circuit according to the first exemplary embodiment.

FIG. 2 is a plan view showing a display device provided with the pixel circuit of the first exemplary embodiment. Hereinafter, explanations will be provided by referring to the drawing.

A display device 30 according to the first exemplary embodiment is AMOLED. Roughly speaking, the display device 30 is constituted with: a TFT substrate 100 in which a plurality of pixel circuits (see FIG. 1A) including light emitting elements are arranged in matrix; a sealing glass substrate 200 which seals the light emitting elements; a glass frit seal part 300 which joins the TFT substrate 100 and the sealing glass substrate 200; and the like. Further, disposed in the periphery of a cathode electrode forming area 114*a* on the outer side of an active matrix part 116 of the TFT substrate 100 are: a scanning driver 131 which drives scan lines (each of control lines) of the TFT substrate 100; an emission control driver 132 which controls the light emission period of each pixel; a data line ESD (Electro-Static-Discharge) protection circuit 133 which prevents damages caused by electrostatic discharge; a de-multiplexer 134 which returns high-transfer rate streams to a plurality of streams of the original low transfer rate; a data driver IC 135 which drives the data lines; and the like. The data driver IC 135 is mounted to the TFT substrate 100 by using an anisotropic conductive film. The TFT substrate 100 is connected to an outer apparatus via an FPC (Flexible Printed Circuit) 136. FIG. 2 is merely an example of the display device according to the first exemplary embodiment, and its shape and structures can be changed as appropriate.

The corresponding relation between FIG. 1A and FIG. 2 is as follows. The first control line S1 and the fourth control line S4 in FIG. 1A are connected to the scanning driver 131 in FIG. 2. The second control line S2 and the third control line S3 in FIG. 1A are connected to the emission control driver 132 in FIG. 2. The data line D1 in FIG. 1A is connected to the de-multiplexer 134 and the data driver IC 135 in FIG. 2. The first to third power supply lines P1 to P3 in FIG. 1A are connected to an external power source via the FPC 136 in FIG. 2.

Figure 3:
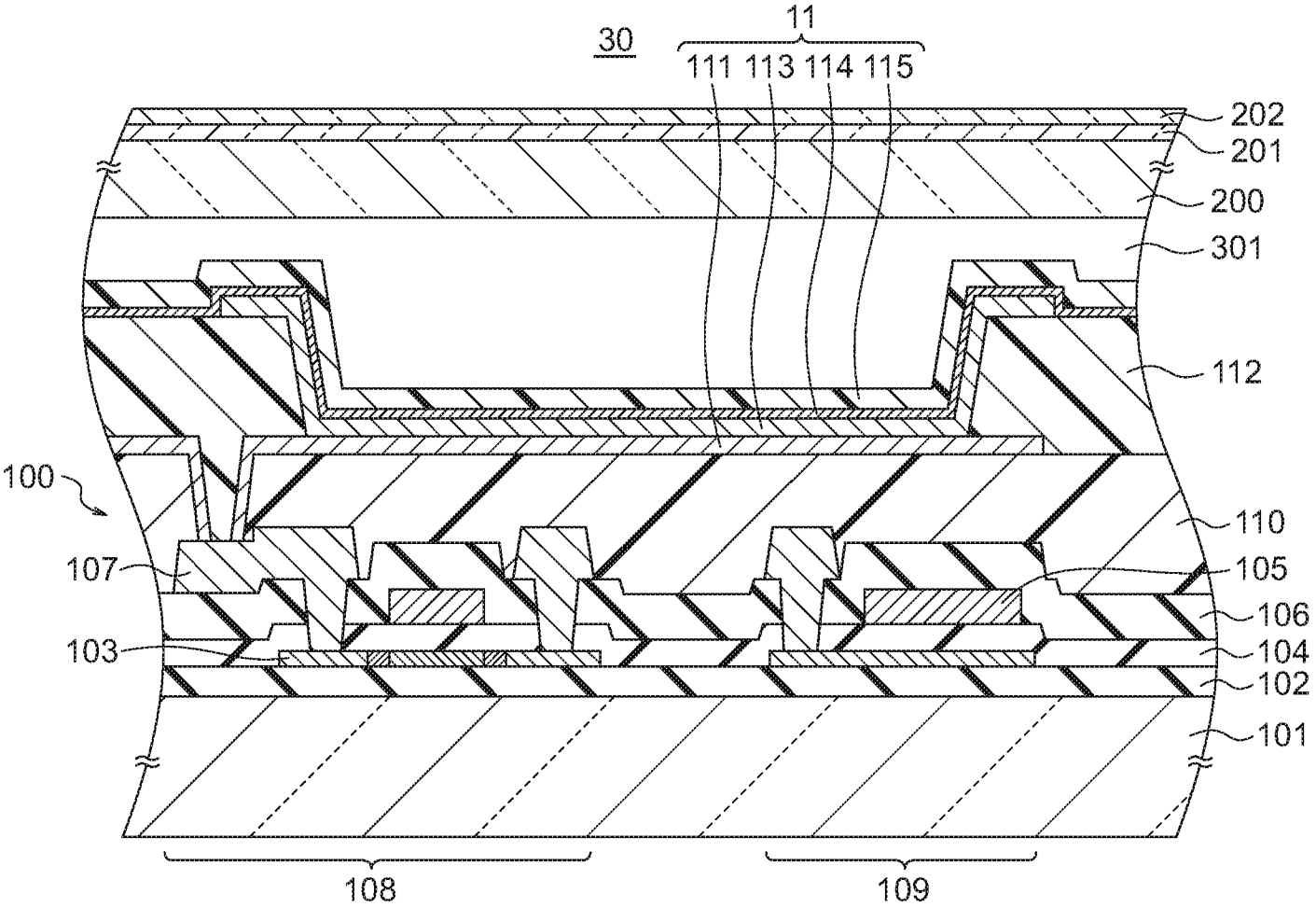
FIG. 3 is a fragmentary enlarged sectional view of FIG. 2.

FIG. 3 is a fragmentary enlarged sectional view of FIG. 2. Hereinafter, explanations will be provided by referring to the drawing.

The TFT substrate 100 is constituted with: a polysilicon layer 103 formed with low temperature polysilicon (Low Temperature Polycrystalline Silicon) and the like formed on the glass substrate 101 via a base insulating film 102; a first metal layer 105 (gate electrode and capacitor electrode) formed via a gate insulating film 104; a second metal layer 107 (data line, power supply line, source and drain electrodes, and contact part) connected to the polysilicon layer 103 via an opening formed in an interlayer insulating film 106; and the light emitting element 11 (anode electrode 111, organic EL layer 113, cathode electrode 114, and cap layer 115) formed in the recessed part of an element separating film 112 via a flattening film 110. The polysilicon layer 103 in the TFT region 108 is in an LDD (Lightly Doped Drain) structure in which a p+ layer, a p− layer, an i layer, a p− layer, and a p+ layer are formed in this order from the left side. The polysilicon layer 103 in the capacitor region 109 is a p+ layer.

Dry air 301 is sealed between the light emitting element 11 and the sealing glass substrate 200. Through sealing those by the glass frit seal part 300 (FIG. 2), the display device 30 is formed. The light emitting element 11 is of a top emission structure, in which the light emitting element 11 and the sealing glass substrate 200 are set with a prescribed space therebetween, and λ/4 phase difference plate 201 and a polarization plate 202 are formed on the light exit side of the sealing glass substrate 200 so that the reflection of the light making incident from the outer side can be suppressed.

While FIG. 3 shows the top emission structure with which each irradiated light of the light emitting element 11 is irradiated towards the outside via the sealing glass substrate 200, it is also possible to employ a bottom emission structure with which the light is irradiated towards the outside via the glass substrate 101.

FIG. 4A to FIG. 7B show actions (driving method) of the pixel circuit according to the first exemplary embodiment. FIG. 4A, FIG. 5A, FIG. 6A, and FIG. 7A are circuit diagrams of first to fourth periods. Further, FIG. 4B, FIG. 5B, FIG. 6B, and FIG. 7B are timing charts of the first to fourth periods. Hereinafter, the actions (driving method) of the pixel circuit according to the first exemplary embodiment will be described by adding FIG. 4A to FIG. 7B to FIG. 1A and FIG. 1B.

A part of reference numerals applied in FIG. 1A is omitted in FIG. 4A, FIG. 5A, FIG. 6A, and FIG. 7A for allowing the drawings to be easily comprehended. Marks "X" in FIG. 4A, FIG. 5A, FIG. 6A, and FIG. 7A are transistors in an off state. The pixel circuit is driven by the driving method of the pixel circuit, so that it is expressed as the actions (driving method) of the pixel circuit.

First, the outline of the driving method of the pixel circuit 10 will be described by referring to FIG. 1A and FIG. 1B. The driving method of the pixel circuit 10 includes the following first to fourth periods T1 to T4. In this case, the switch part 13 operates as follows.

The voltage held to the capacitor 12 is initialized in the first period T1. In the second period T2 after the first period T1, the voltage containing the threshold voltage Vth of the first transistor (M1) is held to the capacitor part 12 through turning on the reference voltage transistor (M5).

In the third period T3 after the second period T2, the data voltage Vdata is supplied to the capacitor part 12 and the voltage containing the threshold voltage Vth and the data voltage Vdata is held to the capacitor part 12 through turning on the data voltage transistor (M1). In the fourth period T4 after the third period T3, an electric current according to the data voltage Vdata is supplied to the light emitting element 11 by applying the voltage held by the capacitor part 12 to the driving transistor (M3).

More specifically, in the first period T1, the voltage hold to the capacitor part 12 is initialized.

In the second period T2, the voltage containing the threshold voltage Vth of the driving transistor (M3) is held to the capacitor part 12 through turning on the reference voltage transistor (M5) and turning off the data voltage transistor (M1).

In the third period T3, the data voltage Vdata is supplied to the capacitor part 12 and the voltage containing the threshold voltage Vth and the data voltage Vdata is held to the capacitor part 12 through turning off the reference voltage transistor (M5) and turning on the data voltage transistor (M1).

In the fourth period T4, an electric current according to the data voltage Vdata is supplied to the light emitting element 11 through applying the voltage held by the capacitor part 12 between the gate terminal and the source terminal of the driving transistor (M3).

Next, each period will be described in details.

Figure 4B:
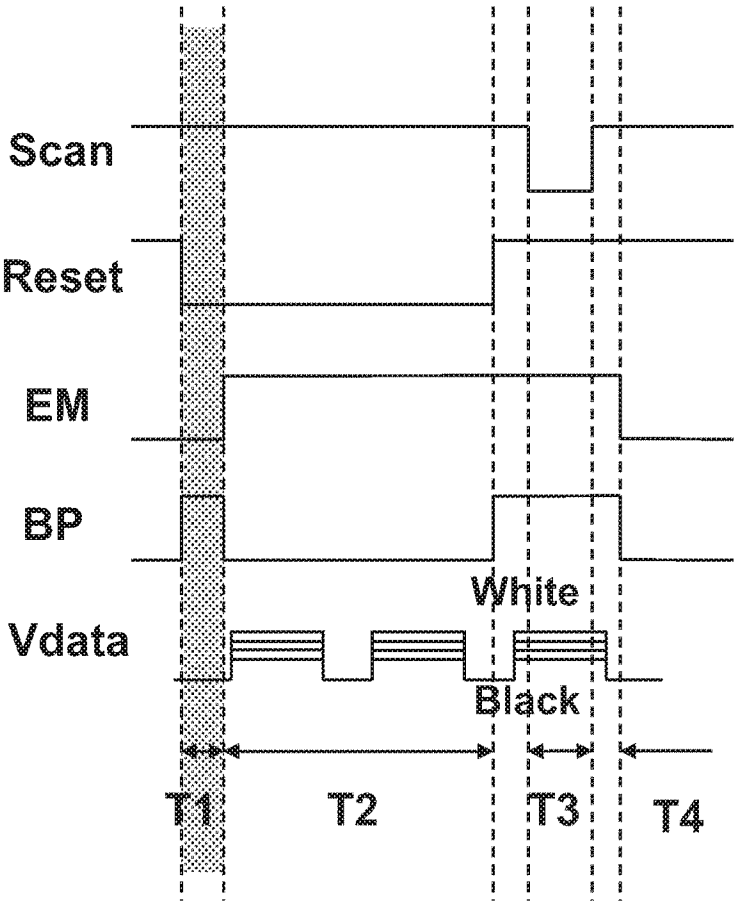
Figure 4A:
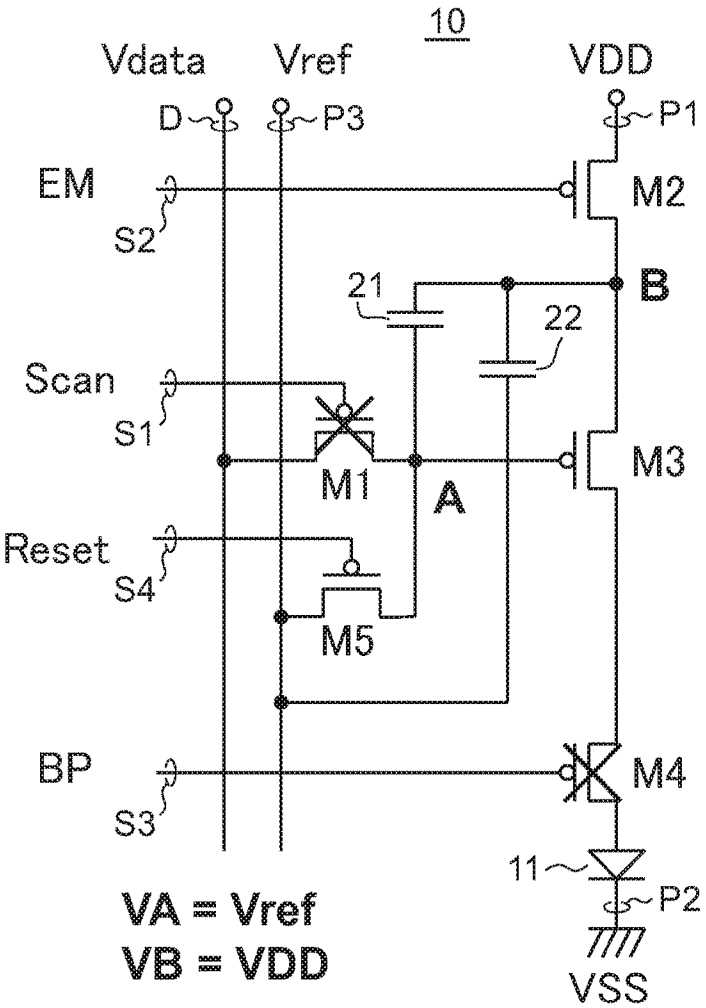

In the first period T1 shown in FIG. 4A and FIG. 4B, the voltages of the first to fourth control lines S1 to S4 are set so that the first transistor M1 and the fourth transistor M4 are turned off and the second transistor M2, the third transistor M3, and the fifth transistor M5 are turned on.

At this time, the voltage VA of the node A turns to the third power supply voltage Vref via the fifth transistor M5, and the voltage VB of the node B turns to the first power supply voltage VDD via the second transistor M2. That is, the voltage VA of the node A and the voltage VB of the node B can be expressed as follows, and the voltages held by the first and the second capacitors 21 and 22 are initialized.

$$VA=Vref$$

$$VB=VDD$$

Figure 5B:
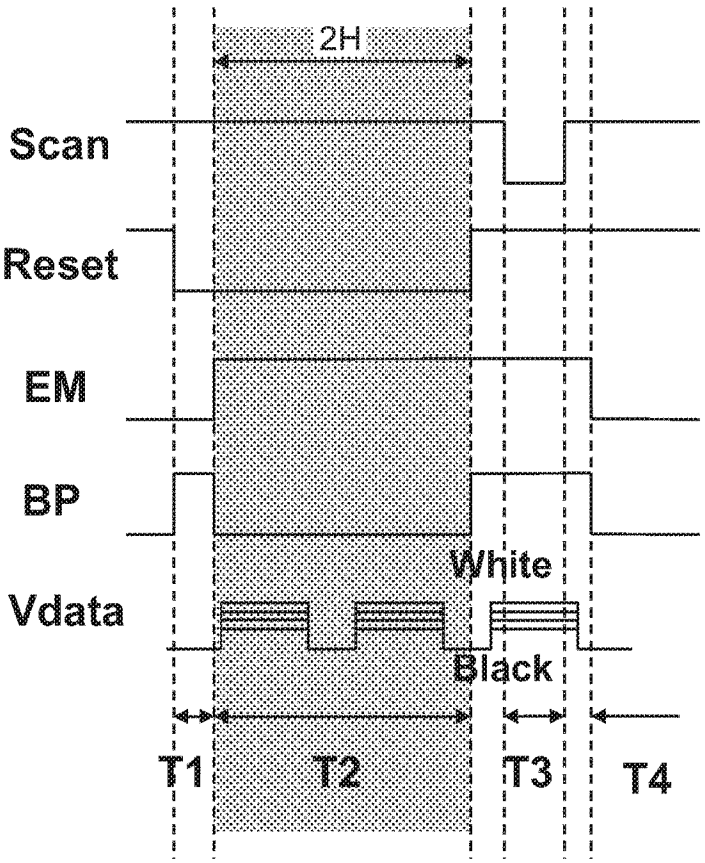
Figure 5A:
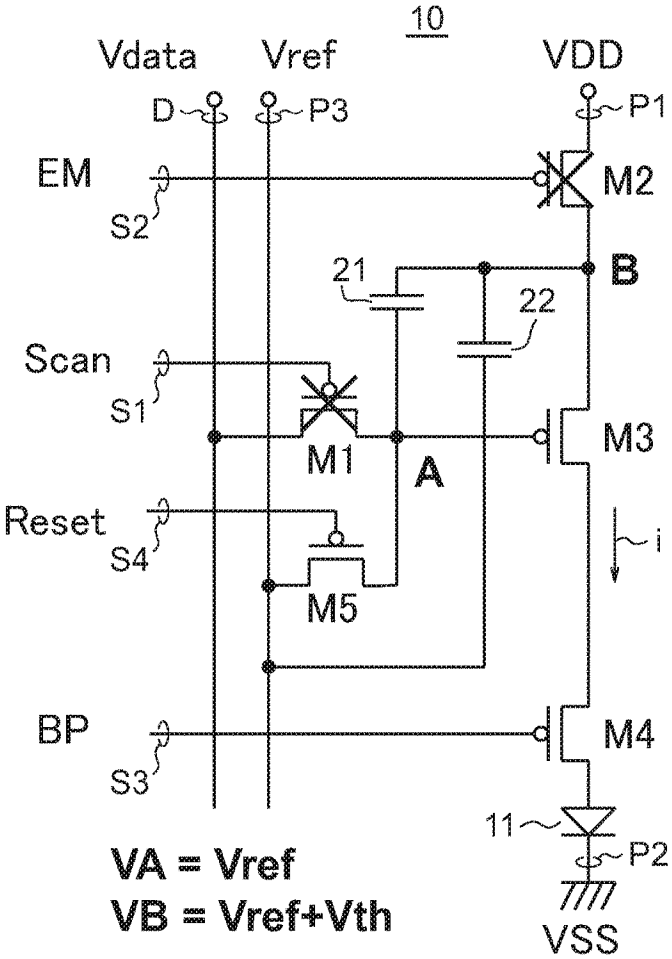

In the second period T2 shown in FIG. 5A and FIG. 5B, the voltages of the first to fourth control lines S1 to S4 are set so that the first transistor M1 and the second transistor M2 are turned off and the third transistor M3, the fourth transistor M4, and the fifth transistor M5 are turned on.

At this time, the voltage VA of the node A turns to the third power supply voltage Vref via the fifth transistor M5. Thus, the electric charges held by the first and second capacitors 21 and 22 are discharged via the third transistor M3 and the fourth transistor M4, so that an electric current i is flown from the third transistor M3. Thus, the voltage VB of the node B is decreased from the first power supply voltage VDD. When the voltage VB of the node B is decreased to be Vref+Vth, the third transistor M3 is set off. That is, the voltage VA of the node A and the voltage VB of the node B can be expressed as follows, and the voltage containing the threshold voltage Vth of the third transistor M3 is held to the first and second capacitors 21 and 22. As described, the first exemplary embodiment uses source follower type threshold voltage detection.

$$VA=Vref$$

$$VB=Vref+Vth$$

The third power supply voltage Vref that is required for detecting the threshold voltage is supplied from the third power supply line P3 that is different from the data line D via the fifth transistor M5. Thus, there is no influence of the data line being imposed while detecting the threshold voltage, so that crosstalk is not generated theoretically. Therefore, it is possible to detect the threshold voltage Vth within the time of N (natural number)×H (horizontal scanning period). As a result, the threshold voltage Vth can be detected with a sufficient time, the threshold voltage Vth is obtained precisely, so that the compensation performance of the threshold voltage Vth is increased. Note that the first exemplary embodiment is a case where N=2.

Further, the third transistor M3 as a driving transistor is turned on temporarily at the time of detecting the threshold voltage. Thus, before driving the light emitting element 11, the small electric current i can be flown to the third transistor M3 every time. If the small electric current i is in an amount that is sufficient to prevent the hysteresis characteristic of the third transistor M3 from being initialized, it is possible to perform the drive with a same characteristic at all times regardless of the levels of the data signals. Thus, no image retention is generated.

Figure 6A:
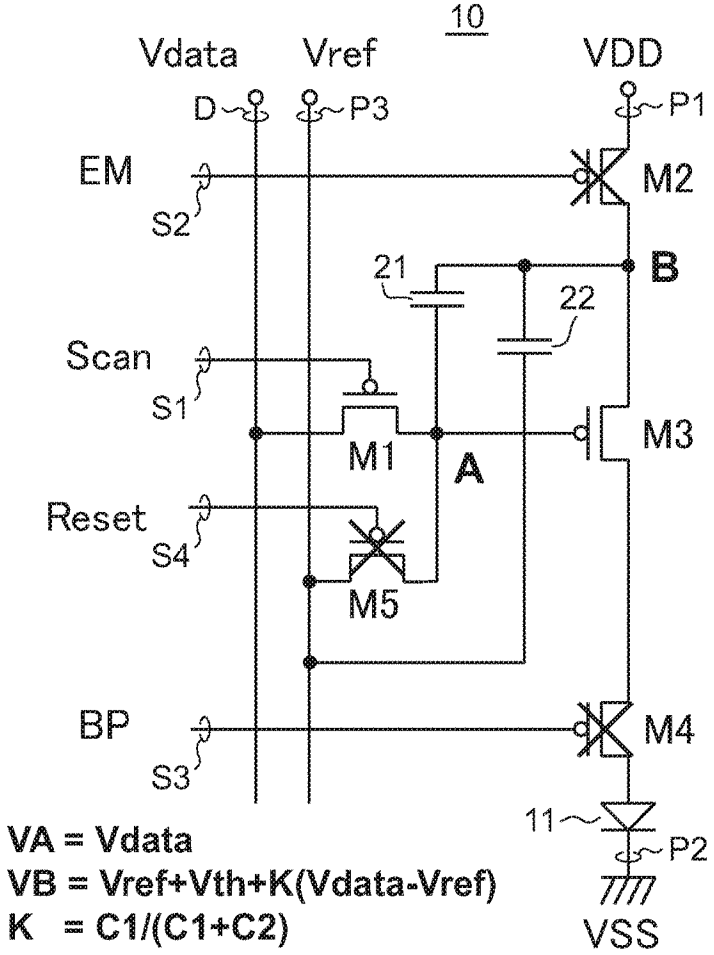
Figure 6B:
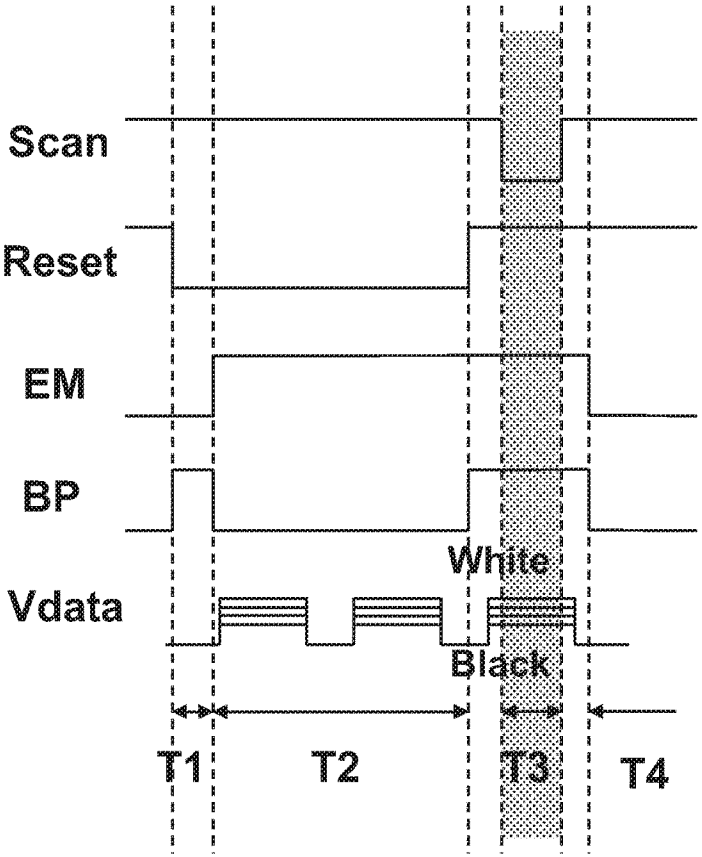

In the third period T3 shown in FIG. 6A and FIG. 6B, the voltages of the first to fourth control lines S1 to S4 are set so that the second transistor M2, the fourth transistor M4, and the fifth transistor M5 are turned off and the first transistor M1 and the third transistor M3 are turned on. Further, the data voltage Vdata is supplied from the data line D.

At this time, the voltage VA of the node A turns to the data voltage Vdata via the first transistor M1. In the meantime, assuming that the capacitance values of the first and second capacitors 21 and 22 are C1 and C2, respectively, the voltage VB of the node B is increased by K (Vdata−Vref) that is divided voltages of the first and second capacitors 21 and 22 which are connected in series and can be expressed as in following expressions. That is, through supplying the data voltage Vdata to the first and second capacitors 21 and 22, the voltage containing the threshold voltage Vth and the data voltage Vdata is held to the first and second capacitors 21 and 22.

$$VA=Vdata$$

$$VB=Vref+Vth+K(Vdata-Vref)$$

$$K=C1/(C1+C2)$$

It is defined here that C1<C2, i.e., K<½. The reason thereof is for increasing the value of the term of Vdata applied to the third transistor M3 as can be seen from expressions to be described later.

Figure 7A:
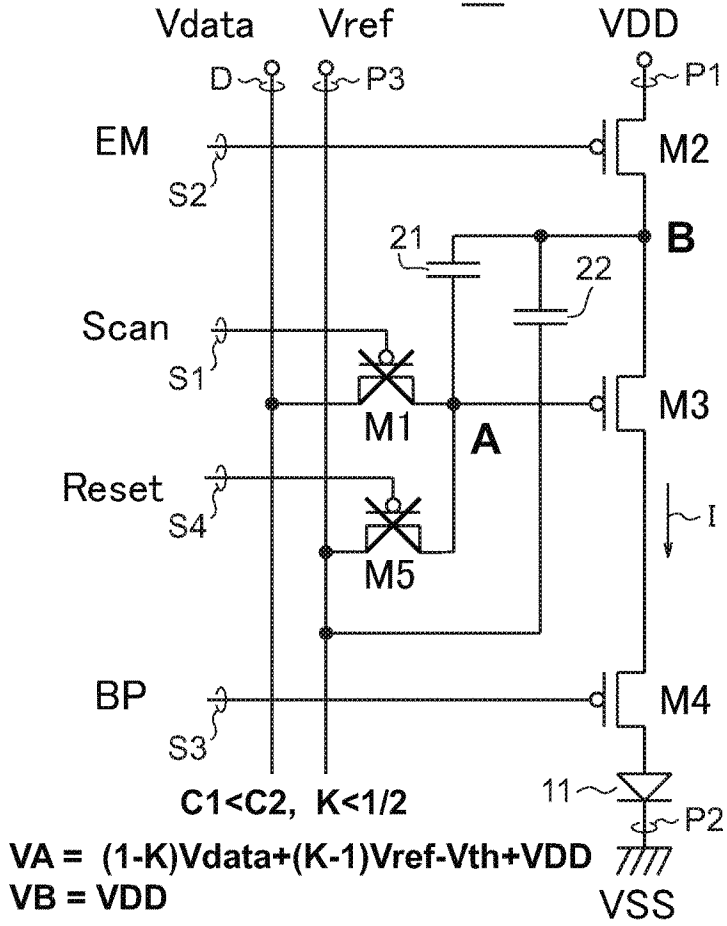
Figure 7B:
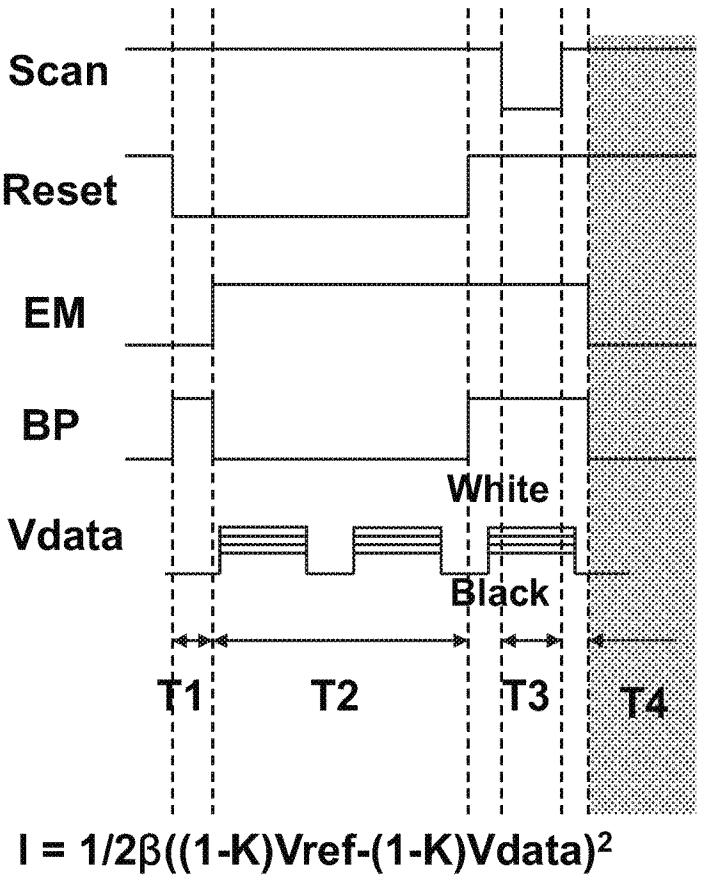

In the fourth period T4 shown in FIG. 7A and FIG. 7B, the voltages of the first to fourth control lines S1 to S4 are set so that the first transistor M1 and the fifth transistor M5 are turned off and the second transistor M2, the third transistor M3, and the fourth transistor M4 are turned on.

At this time, the voltage VB of the node B turns to the first power supply voltage VDD via the second transistor M2. In the meantime, the voltage VA of the node A can be expressed as follows since the difference acquired by subtracting the voltage VB in the third period T3 from the first power supply voltage VDD is added to the voltage VA of the third period T3.

$$\begin{aligned} VA &= Vdata + (VDD - Vref - Vth - K(Vdata - Vref)) \\ &= (1-K)Vdata + (K-1)Vref - Vth + VDD \\ VB &= VDD \end{aligned}$$

Thereby, the voltage applied between the gate terminal and the source terminal of the third transistor M3 is VB−VA. Thus, the electric current I flown in the drain terminal thereof can be given by following expressions.

$$\begin{aligned} I &= \frac{1}{2}\beta((VB-VA)-Vth)^2 \\ &= \frac{1}{2}\beta((VDD-((1-K)Vdata+(K-1)Vref-Vth+VDD)-Vth)^2 \\ &= \frac{1}{2}\beta((1-K)Vref-(1-K)Vdata)^2 \end{aligned}$$

As can be seen from the above expressions, the electric current I does not contain the term of the threshold voltage Vth. Thus, it is not affected by variation and fluctuation of the threshold voltage Vth. This is the variation compensation function of the threshold voltage Vth of the pixel circuit 10. Note that β in the above expressions is a constant determined according to the structure and the material of the third transistor M3.

As described above, in the fourth period T4, the electric current I according to the data voltage Vdata is supplied to the light emitting element 11 through applying the voltages held by the first and second capacitors 21 and 22 between the gate terminal and the source terminal of the third transistor M3.

Note that VDD>Vref>VSS applies, and VDD=10 V, VSS=0 V, Vref=7 to 8 V, and Vdata=1 to 6 V, for example.

In other words, the effects of the first exemplary embodiment are as follows. 1) The circuit is designed to control the threshold voltage detection period independently, so that the threshold voltage can be detected with high precision by taking a sufficiently long time. Thus, a high compensation capability for display unevenness can be achieved and a more uniform display characteristic can be acquired. 2) There is no influence of the change in the data signals imposed in the threshold voltage detection period, so that crosstalk is not generated theoretically. 3) A small electric current is flown to the OLED driving transistor every time the OLED is driven, so that no issue regarding image retention occurs. 4) As described above, the compensation capability for variation and fluctuation of the threshold voltage is high and no crosstalk is generated, so that a high image quality can be achieved. Further, it is easy employ a multiplexer as will be described later. Therefore, the number of output pins of the data driver IC can be decreased, so that it is practical.

(Second Exemplary Embodiment)

Figure 8:
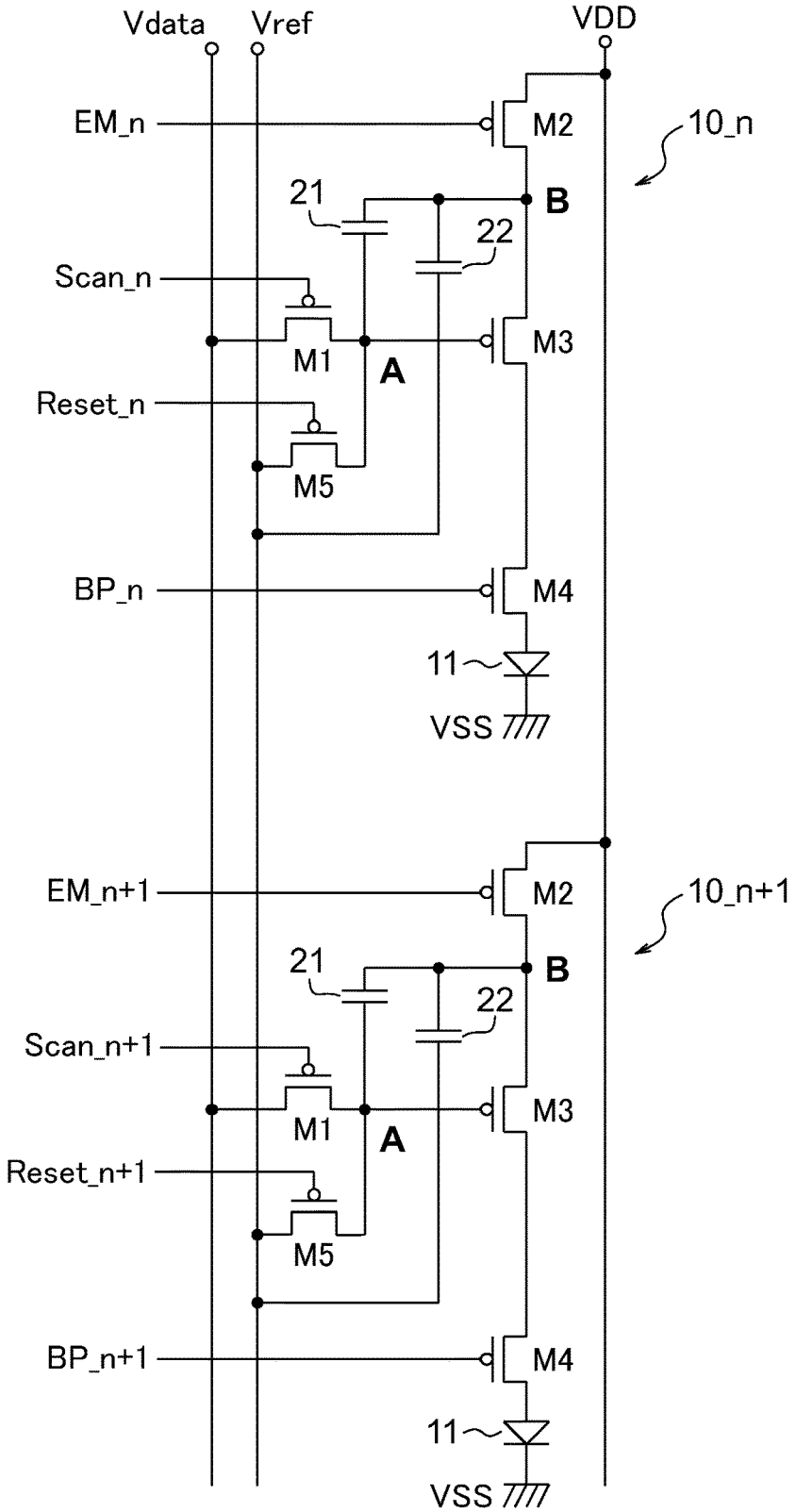
FIG. 8 is a circuit diagram showing the structure of a pixel circuit according to a second exemplary embodiment.
Figure 9:
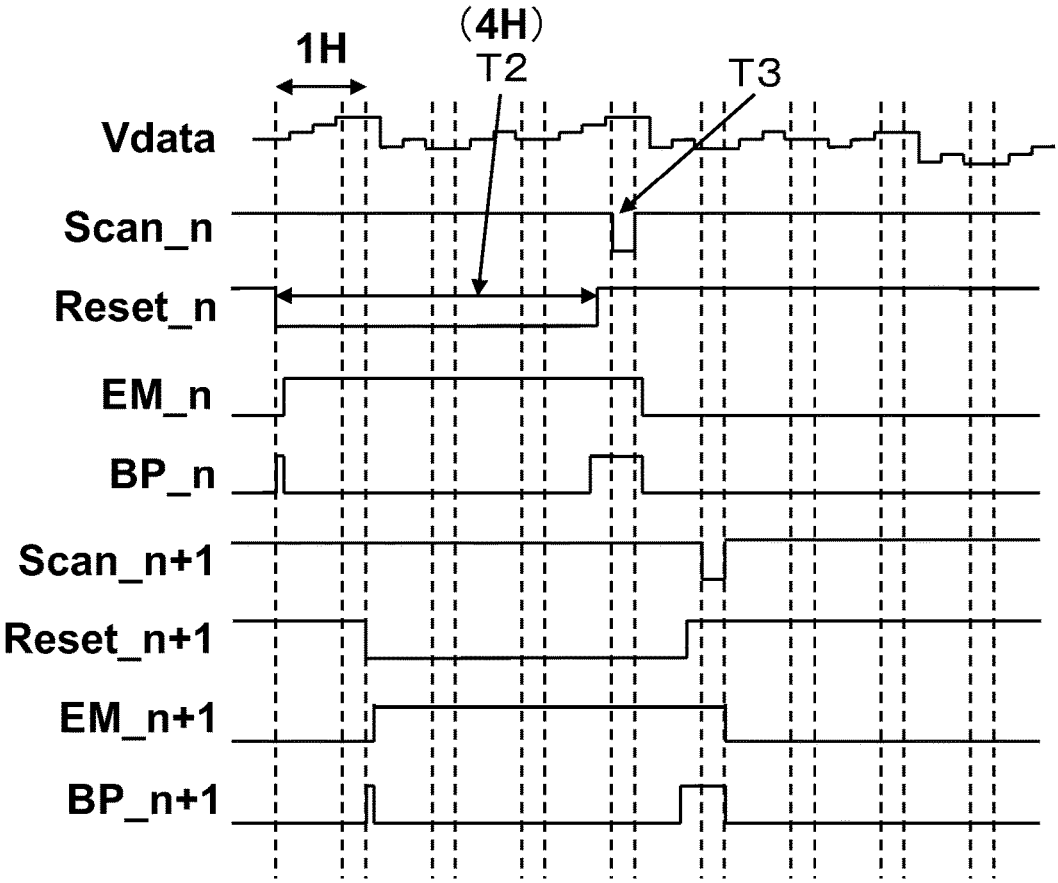
FIG. 9 is a timing chart showing actions of the pixel circuit according to the second exemplary embodiment.

FIG. 8 is a circuit diagram showing the structure of a pixel circuit according to a second exemplary embodiment. FIG. 9 is a timing chart showing actions of the pixel circuit of the second exemplary embodiment. Explanations will be provided hereinafter by referring to those drawings.

In the second exemplary embodiment, only the length of the second period T2 as the threshold voltage detection period is different from that of the first exemplary embodiment. Therefore, the structures of two neighboring pixel circuits 10_*n* and 10_*n*+1 disposed along the extending direction of the data line are the same as the pixel circuit of the first exemplary embodiment. In FIG. 8, a part of reference numerals applied in FIG. 1A is omitted to be easily comprehended.

To the pixel circuit 10_*n*, a first control signal Scan_n, a second control signal EM_n, a third control signal BP_n, and a fourth control signal Reset_n are outputted. To the pixel circuit 10_*n*+1, a first control signal Scan_n+1, a second control signal EM_n+1, a third control signal BP_n+1, and a fourth control signal Reset_n+1 are outputted. The first control signal Scan_n+1 and the like are outputted by being delayed for one horizontal scanning period 1H from the first control signal Scan_n and the like.

While the second period T2 as the threshold voltage detection period is two horizontal scanning periods 2H on the first exemplary embodiment, it is four horizontal scanning periods 4H that is twice as long in the second exemplary embodiment. Thus, the threshold voltage detection period can be secured more sufficiently, so that the threshold voltage compensation performance can be improved further. Note that the threshold voltage detection period is not limited only to the two horizontal scanning period 2H or the four horizontal scanning period 4H but may be eight horizontal scanning periods 8H or sixteen horizontal scanning periods 16H, for example.

Other structures, operations, and effects of the second exemplary embodiment are the same as those of the first exemplary embodiment.

(Third Exemplary Embodiment)

Figure 10B:
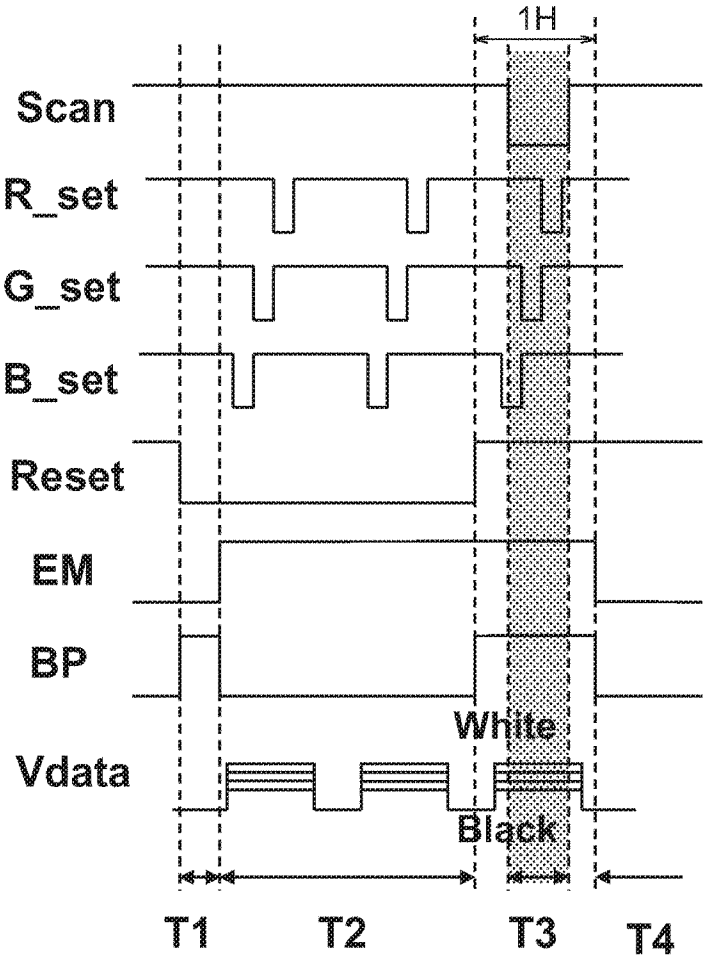
Figure 10A:
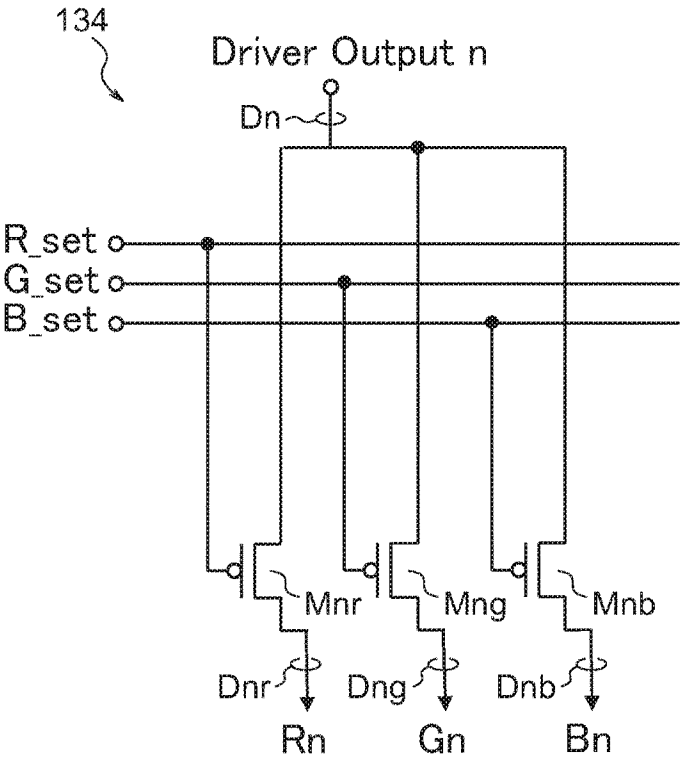
Figure 11A:
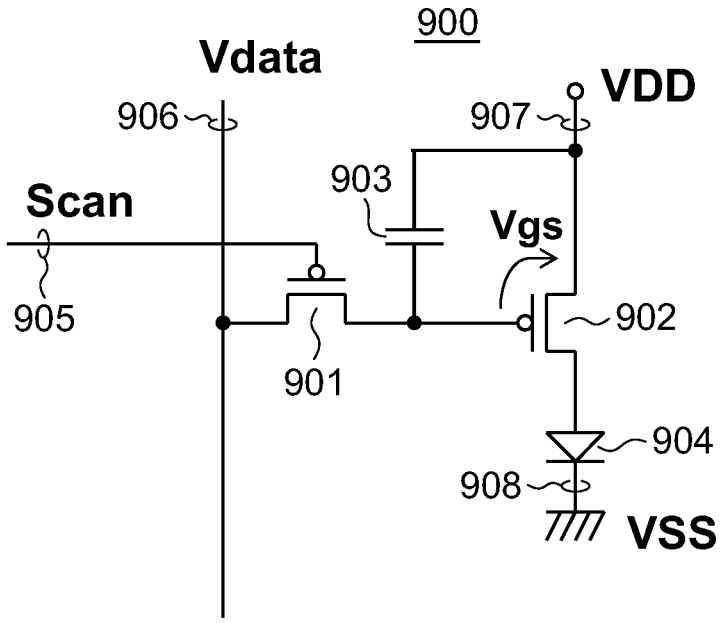
Figure 11B:
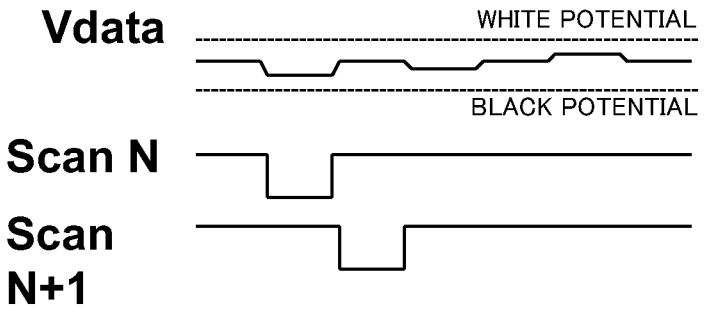
Figure 11C:
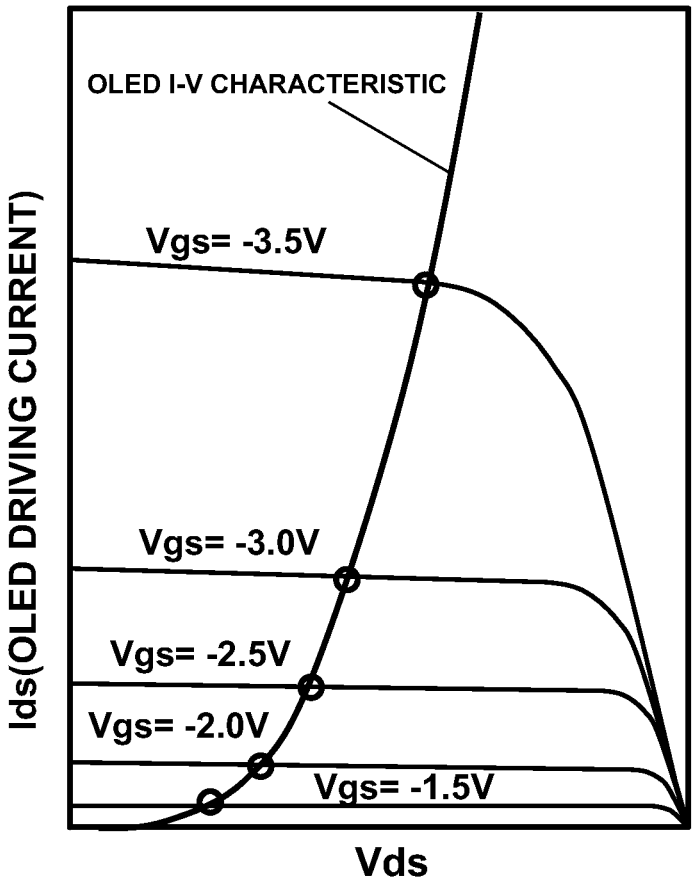

FIG. 10A is a circuit diagram showing the structure of a pixel circuit according to a third exemplary embodiment, and FIG. 10B is a timing chart showing actions of the pixel circuit of the third exemplary embodiment. Explanations will be provided hereinafter by referring to those drawings.

The display device of the third exemplary embodiment exhibits a specific feature in its multiplexer 134. The multiplexer 134 shown in FIG. 10A is for one pixel. In a case where the pixel circuit of the first exemplary embodiment is a sub-pixel, a single pixel is constituted with three sub-pixels of R (Red), G (Green), and B (Blue). Each of the pixel circuits is in an RGB vertical stripe layout structure, for example.

The de-multiplexer 134 selects one data line sequentially from three data lines Dnr, Dng, and Dnb each being connected to three respective pixel circuits, and connects the selected single data line to another single data line Dn that is connected to a supply source (a data driver IC 135 shown in FIG. 2) of the data voltage Vdata. Each of the data lines Dnr, Dng, and Dnb corresponds to the data line D in FIG. 1A.

The de-multiplexer 134 includes three switch transistors Mnr, Mng, and Mnb per pixel. Each of the transistors Mnr, Mng, and Mnb is selectively connected to a single data line Dn out of the three data lines Dnr, Dng, and Dnb according to the fifth control signals R_set, G_set, and B_set. A data voltage Rn is outputted from the data line Dn to the data line Dnr via the transistor Mnr, a data voltage Rg is outputted from the data line Dn to the data line Dng via the transistor Mng, and a data voltage Rb is outputted from the data line Dn to the data line Dnb via the transistor Mnb.

The fifth control signals R_set, G_set, and B_set are outputted within one horizontal scanning period by shifting the time so as not overlap with each other. After data voltages Rr, Rg, and Rb of all the data lines Dnr, Dng, and Dnb are settled, the transistor M1 (FIG. 1A) is turned on. Through the use of the de-multiplexer 134, the total numbers of the data lines D of the data driver IC 135 (FIG. 2) can be decreased.

In an existing pixel circuit using a de-multiplexer which distributes the data voltage outputted from a single data line to three data lines, it is required to execute both detection of the threshold voltage and data writing within one horizontal scanning period. However, when one horizontal scanning period becomes shorter due to the increase in the number of scanning lines caused by achieving higher definition, the writing time per data line becomes shorter so that data writing becomes insufficient.

In the meantime, the display device of the third exemplary embodiment uses the pixel circuit of the first exemplary embodiment so that almost the entire one horizontal scanning period 1H (the third period T3) can be used for data wiring by the de-multiplexer 134. Thus, it is possible to have a sufficient pulse width of the fifth control signals R_set, G_set, and B_set, which makes it possible to improve the display performance.

Other structures, operations, and effects of the third exemplary embodiment are the same as those of the first and second exemplary embodiments.

While the present invention has been described by referring to each of the above exemplary embodiments, the present invention is not limited only to the structures and the actions of each of the above-described exemplary embodiments but includes various kinds of changes and modifications occurred to those skilled in the art without departing from the scope of the present invention. Further, the present invention also includes those acquired by combining a part of or a whole part of each of the above-described exemplary embodiments as appropriate.

For example, while all the transistors are the p-channel type in each of the above exemplary embodiments, the transistors are not limited only to that type. A part of or the entire transistors may be n-channel type. In a case where the OLED driving transistor is the n-channel type, the conduction direction of the OLED is reversed so that the cathode terminal of the OLED is connected to the drain terminal thereof. The semiconductor material constituting the transistors is not limited to silicon such as LTPS (Low Temperature Polysilicon). An oxide semiconductor such as IGZO (Indium Gallium Zinc Oxide) may be used as well. Further, while the switch part is defined as the source follower type threshold voltage detection structure, it may be a diode connection type threshold voltage detection structure.

While a part of or a whole part of the above-described exemplary embodiments can be depicted as following Supplementary Notes, the present invention is not limited only to the following structures.

(Supplementary Note 1)

A pixel circuit which includes:

a light emitting element;

a driving transistor which supplies an electric current according to an applied voltage to the light emitting element;

a capacitor part which holds a voltage containing a threshold voltage and a data voltage of the driving transistor and applies the voltage to the driving transistor; and a switch part which makes the capacitor part hold the voltage containing the threshold voltage and the data voltage, wherein the switch part includes a reference voltage transistor which inputs a reference voltage from a reference voltage power supply line and a data voltage transistor which inputs the data voltage from a data line.

(Supplementary Note 2)

The pixel circuit as depicted in Supplementary Note 1, wherein:

the driving transistor includes a gate terminal, a source terminal, and a drain terminal, and supplies an electric current according to a voltage applied between the gate terminal and the source terminal to the light emitting element that is connected to the drain terminal;

the capacitor part holds the voltage containing the threshold voltage and the data voltage and applies the voltage between the gate terminal and the source terminal of the driving transistor; and the switch part includes a plurality of transistors including the reference voltage transistor and the data voltage transistor, makes the capacitor part hold the voltage containing the threshold voltage and makes the capacitor part hold the voltage containing the threshold voltage and the data voltage thereafter by switching operations of those transistors, supplies the reference voltage to the capacitor part through turning on the reference voltage transistor and turning off the data voltage transistor when making the capacitor part hold the voltage containing the threshold voltage, and supplies the data voltage to the capacitor part through turning off the reference voltage transistor and turning on the data voltage transistor when making the capacitor part hold the voltage containing the threshold voltage and the data voltage.

(Supplementary Note 3)

The pixel circuit as depicted in Supplementary Note 2, wherein the switch part supplies the reference voltage to the capacitor part through turning on the reference voltage transistor and turning off the data voltage transistor over a time equal to or longer than one horizontal scanning period when making the capacitor part hold the voltage containing the threshold voltage.

(Supplementary Note 4)

The pixel circuit as depicted in Supplementary Note 2 or 3, wherein the switch part temporarily turns on the driving transistor through supplying the reference voltage to the capacitor part when making the capacitor part hold the voltage containing the threshold voltage.

(Supplementary Note 5)

The pixel circuit as depicted in any one of Supplementary Notes 2 to 4, which includes first to fifth transistors, first and second capacitors, and the light emitting element, the pixel circuit being electrically connected to the data line, first to fourth control lines, and first to third power supply lines, wherein:

the third power supply line corresponds to a reference voltage power supply line, the first, second, fourth, and fifth transistors constitute the switch part, the first transistor corresponds to the data voltage transistor, the fifth transistor corresponds to the reference voltage transistor, the third transistor corresponds to the driving transistor, and the first and second capacitors constitute the capacitor part;

the first transistor includes a first terminal that is electrically connected to the data line, a second terminal, and a control terminal that is electrically connected to the first control line;

the second transistor includes a first terminal that is electrically connected to the first power supply line, a second terminal, and a control terminal that is electrically connected to the second control line;

the third transistor includes a first terminal that is electrically connected to the second terminal of the second transistor and corresponds to the source terminal, a second terminal which corresponds to the drain terminal, and a control terminal that is electrically connected to the second terminal of the first transistor and corresponds to the gate terminal;

the fourth transistor includes a first terminal that is electrically connected to the second terminal of the third transistor, a second terminal, and a control terminal that is electrically connected to the third control line;

the fifth transistor includes a first terminal that is electrically connected to the third power supply line, a second terminal that is electrically connected to the second terminal of the first transistor, and a control terminal that is electrically connected to the fourth control line;

the first capacitor includes a first terminal that is electrically connected to the second terminal of the first transistor, and a second terminal that is electrically connected to the first terminal of the third transistor;

the second capacitor includes a first terminal that is electrically connected to the third power supply line, and a second terminal that is electrically connected to the first terminal of the third transistor; and the light emitting element includes a first terminal that is electrically connected to the second terminal of the fourth transistor, and a second terminal that is electrically connected to the second power supply line.

(Supplementary Note 6)

The pixel circuit as depicted in Supplementary Note 5, wherein:

the first transistor is structured to selectively supply the data voltage that is supplied from the data line to the first terminal of the first capacitor;

the second transistor is structured to selectively supply a first power supply voltage that is supplied from the first power supply line to the first terminal of the third transistor, the second terminal of the first capacitor, and the second terminal of the second capacitor;

the third transistor is structured to selectively connect the second terminal of the first capacitor and the second terminal of the second capacitor to the first terminal of the fourth transistor;

the fourth transistor is structured to selectively connect the second terminal of the third transistor to the first terminal of the light emitting element; and the fifth transistor is structured to selectively supply a third power supply voltage which is supplied from the third power supply line and corresponds to the reference voltage to the first terminal of the first capacitor.

(Supplementary Note 7)

A pixel circuit which includes first to fifth transistors, first and second capacitors, and a light emitting element, the pixel circuit being electrically connected to a data line, first to fourth control lines, and first to third power supply lines, wherein:

the first transistor includes a first terminal that is electrically connected to the data line, a second terminal, and a control terminal that is electrically connected to the first control line;

the second transistor includes a first terminal that is electrically connected to the first power supply line, a second terminal, and a control terminal that is electrically connected to the second control line;

the third transistor includes a first terminal that is electrically connected to the second terminal of the second transistor, a second terminal, and a control terminal that is electrically connected to the second terminal of the first transistor;

the fourth transistor includes a first terminal that is electrically connected to the second terminal of the third transistor, a second terminal, and a control terminal that is electrically connected to the third control line;

the fifth transistor includes a first terminal that is electrically connected to the third power supply line, a second terminal that is electrically connected to the second terminal of the first transistor, and a control terminal that is electrically connected to the fourth control line;

the first capacitor includes a first terminal that is electrically connected to the second terminal of the first transistor, and a second terminal that is electrically connected to the first terminal of the third transistor;

the second capacitor includes a first terminal that is electrically connected to the third power supply line, and a second terminal that is electrically connected to the first terminal of the third transistor; and the light emitting element includes a first terminal that is electrically connected to the second terminal of the fourth transistor, and a second terminal that is electrically connected to the second power supply line.

(Supplementary Note 8)

The pixel circuit as depicted in Supplementary Note 7, wherein:

the first transistor is structured to selectively supply the data voltage that is supplied from the data line to the first terminal of the first capacitor;

the second transistor is structured to selectively supply a first power supply voltage that is supplied from the first power supply line to the first terminal of the third transistor, the second terminal of the first capacitor, and the second terminal of the second capacitor;

the third transistor is structured to selectively connect the second terminal of the first capacitor and the second terminal of the second capacitor to the first terminal of the fourth transistor;

the fourth transistor is structured to selectively connect the second terminal of the third transistor to the first terminal of the light emitting element; and the fifth transistor is structured to selectively supply a third power supply voltage which is supplied from the third power supply line to the first terminal of the first capacitor.

(Supplementary Note 9)

The pixel circuit as depicted in any one of Supplementary Notes 5 to 8, wherein the first to fifth transistors are p-channel type transistors.

(Supplementary Note 10)

The pixel circuit as depicted in any one of Supplementary Notes 1 to 9, wherein the light emitting element is an organic light emitting diode.

(Supplementary Note 11)

A display device which includes a plurality of the pixel circuits as depicted in any one of Supplementary Notes 1 to 9 being arranged in matrix.

(Supplementary Note 12)

The display device as depicted in Supplementary Note 11, which further includes a de-multiplexer which, in a case where a single pixel is constituted with a fixed number that is equal to 2 or larger of sub-pixels when assuming that the pixel circuit is a sub-pixel, sequentially selects a single data line from the fixed number of the data lines which are connected, respectively, to a fixed number of the pixel circuits, and connects the selected single data line to another single data line that is connected to a supply source of the data voltage.

(Supplementary Note 13)

A pixel circuit driving method which includes first to fourth periods for driving the pixel circuit depicted in Supplementary Note 1, wherein the switch part:

initializes the voltage held to the capacitor part in the first period;

turns on the reference voltage transistor to make the capacitor part hold the voltage containing the threshold voltage of the driving transistor in the second period after the first period;

turns on the data voltage transistor to supply the data voltage to the capacitor part and make the capacitor part hold the voltage containing the threshold voltage and the data voltage in the third period after the second period; and supplies an electric current according to the data voltage to the light emitting element through applying the voltage held by the capacitor part to the driving transistor in the fourth period after the third period.

(Supplementary Note 14)

A pixel circuit driving method which includes first to fourth period for driving the pixel circuit depicted in any one of Supplementary Notes 2 to 4, wherein the switch part:

initializes the voltage held to the capacitor part in the first period;

turns on the reference voltage transistor and turns off the data voltage transistor to make the capacitor part hold the voltage containing the threshold voltage of the driving transistor in the second period after the first period;

turns off the reference voltage transistor and turns on the data voltage transistor to supply the data voltage to the capacitor part and make the capacitor part hold the voltage containing the threshold voltage and the data voltage in the third period after the second period; and supplies an electric current according to the data voltage to the light emitting element through applying the voltage held by the capacitor part between the gate terminal and the source terminal of the driving transistor in the fourth period after the third period.

(Supplementary Note 15)

A pixel circuit driving method which includes first to fourth period for driving the pixel circuit depicted in any one of Supplementary Notes 5 to 10, wherein:

in the first period, voltages of the first to fourth control lines are set so that the first transistor and the fourth transistor are turned off and the second transistor, the third transistor, and the fifth transistor are turned on;

in the second period after the first period, the voltages of the first to fourth control lines are set so that the first transistor and the second transistor are turned off and the third transistor, the fourth transistor, and the fifth transistor are turned on;

in the third period after the second period, the voltages of the first to fourth control lines are set so that the second transistor, the fourth transistor, and the fifth transistor are turned off, the first transistor and the third transistor are turned on, and the data voltage is supplied from the data line; and in the fourth period after the third period, the voltages of the first to fourth control lines are set so that the first transistor and the fifth transistor are turned off and the second, the third transistor, and the fourth transistor are turned on.

(Supplementary Note 16)

The pixel circuit driving method depicted in any one of Supplementary Notes 13 to 15, wherein the second period is a time equal to or longer than one horizontal scanning period.

What is claimed is:

1. A pixel circuit, comprising:

a light emitting element;

a driving transistor which supplies an electric current according to an applied voltage to the light emitting element;

a capacitor part which holds a voltage containing a threshold voltage and a data voltage of the driving transistor and applies the voltage to the driving transistor; and a switch part which causes the capacitor part to hold the voltage containing the threshold voltage and the data voltage, wherein the switch part includes a reference voltage transistor which inputs a reference voltage from a reference voltage power supply line and a data voltage transistor which inputs the data voltage from a data line, and wherein, from the capacitor part to the driving transistor, an electric current which turns on the driving transistor to prevent a hysteresis characteristic of the driving transistor from being initialized is flown before driving the light emitting element.

2. The pixel circuit as claimed in claim 1, wherein the light emitting element is an organic light emitting diode.

3. The pixel circuit as claimed in claim 1, wherein:

the driving transistor comprises a gate terminal, a source terminal, and a drain terminal, and supplies an electric current according to a voltage applied between the gate terminal and the source terminal to the light emitting element that is connected to the drain terminal;

the capacitor part holds the voltage containing the threshold voltage and the data voltage of the driving transistor and applies the voltage between the gate terminal and the source terminal of the driving transistor; and the switch part includes a plurality of transistors including the reference voltage transistor and the data voltage transistor, causes the capacitor part to hold the voltage containing the threshold voltage, and causes the capacitor part to hold the voltage containing the threshold voltage and the data voltage thereafter by switching operations of those transistors, the reference voltage supplied to the capacitor part through turning on the reference voltage transistor and turning off the data voltage transistor when making the capacitor part hold the voltage containing the threshold voltage, and the data voltage supplied to the capacitor part through turning off the reference voltage transistor and turning on the data voltage transistor when making the capacitor part hold the voltage containing the threshold voltage and the data voltage.

4. The pixel circuit as claimed in claim 3, wherein the switch part supplies the reference voltage to the capacitor part through turning on the reference voltage transistor and turning off the data voltage transistor over a time equal to or longer than one horizontal scanning period when making the capacitor part hold the voltage containing the threshold voltage.

5. The pixel circuit as claimed in claim 3, wherein the switch part temporarily turns on the driving transistor through supplying the reference voltage to the capacitor part when making the capacitor part hold the voltage containing the threshold voltage.

6. The pixel circuit as claimed in claim 3, comprising first to fifth transistors, first and second capacitors, and the light emitting element, the pixel circuit being electrically connected to the data line, first to fourth control lines, and first to third power supply lines, wherein:

the third power supply line corresponds to a reference voltage power supply line, the first, second, fourth, and fifth transistors constitute the switch part, the first transistor corresponds to the data voltage transistor, the fifth transistor corresponds to the reference voltage transistor, the third transistor corresponds to the driving transistor, and the first and second capacitors constitute the capacitor part;

the first transistor includes a first terminal that is electrically connected to the data line, a second terminal, and a control terminal that is electrically connected to the first control line;

the second transistor includes a first terminal that is electrically connected to the first power supply line, a second terminal, and a control terminal that is electrically connected to the second control line;

the third transistor includes a first terminal that is electrically connected to the second terminal of the second transistor and corresponds to the source terminal, a second terminal which corresponds to the drain terminal, and a control terminal that is electrically connected to the second terminal of the first transistor and corresponds to the gate terminal;

the fourth transistor includes a first terminal that is electrically connected to the second terminal of the third transistor, a second terminal, and a control terminal that is electrically connected to the third control line;

the fifth transistor includes a first terminal that is electrically connected to the third power supply line, a second terminal that is electrically connected to the second terminal of the first transistor, and a control terminal that is electrically connected to the fourth control line;

the first capacitor includes a first terminal that is electrically connected to the second terminal of the first transistor, and a second terminal that is electrically connected to the first terminal of the third transistor;

the second capacitor includes a first terminal that is electrically connected to the third power supply line, and a second terminal that is electrically connected to the first terminal of the third transistor; and the light emitting element includes a first terminal that is electrically connected to the second terminal of the fourth transistor, and a second terminal that is electrically connected to the second power supply line.

7. The pixel circuit as claimed in claim 6, wherein the first to fifth transistors are p-channel type transistors.

8. The pixel circuit as claimed in claim 6, wherein:

the first transistor is structured to selectively supply the data voltage that is supplied from the data line to the first terminal of the first capacitor;

the second transistor is structured to selectively supply a first power supply voltage that is supplied from the first power supply line to the first terminal of the third transistor, the second terminal of the first capacitor, and the second terminal of the second capacitor;

the third transistor is structured to selectively connect the second terminal of the first capacitor and the second terminal of the second capacitor to the first terminal of the fourth transistor;

the fourth transistor is structured to selectively connect the second terminal of the third transistor to the first terminal of the light emitting element; and the fifth transistor is structured to selectively supply a third power supply voltage which is supplied from the third power supply line and corresponds to the reference voltage to the first terminal of the first capacitor.

9. A display device, comprising a plurality of the pixel circuits claimed in claim 1 being arranged in matrix.

10. The display device as claimed in claim 9, further comprising:

a de-multiplexer which, in a case where a single pixel is constituted with a fixed number that is equal to 2 or larger of sub-pixels when assuming that the pixel circuit is a sub-pixel, sequentially selects a single data line from the fixed number of the data lines which are connected, respectively, to a fixed number of the pixel circuits, and connects the selected single data line to another single data line that is connected to a supply source of the data voltage.

11. The pixel circuit as claimed in claim 1, wherein the switch part flows, from the capacitor part to the driving transistor and the light emitting element, an electric current which turns on the driving transistor to prevent a hysteresis characteristic of the driving transistor from being initialized, before driving the light emitting element.

12. A pixel circuit, comprising:

first to fifth transistors;

first and second capacitors; and a light emitting element, the pixel circuit being electrically connectable to a data line, first to fourth control lines, and first to third power supply lines, wherein:

the first transistor includes a first terminal that is electrically connected to the data line, a second terminal, and a control terminal that is electrically connected to the first control line;

the second transistor includes a first terminal that is electrically connected to the first power supply line, a second terminal, and a control terminal that is electrically connected to the second control line;

the third transistor includes a first terminal that is electrically connected to the second terminal of the second transistor, a second terminal, and a control terminal that is electrically connected to the second terminal of the first transistor;

the fourth transistor includes a first terminal that is electrically connected to the second terminal of the third transistor, a second terminal, and a control terminal that is electrically connected to the third control line;

the fifth transistor includes a first terminal that is electrically connected to the third power supply line, a second terminal that is electrically connected to the second terminal of the first transistor, and a control terminal that is electrically connected to the fourth control line;

the first capacitor includes a first terminal that is electrically connected to the second terminal of the first transistor, and a second terminal that is electrically connected to the first terminal of the third transistor;

the second capacitor includes a first terminal that is electrically connected to the third power supply line, and a second terminal that is electrically connected to the first terminal of the third transistor;

the light emitting element includes a first terminal that is electrically connected to the second terminal of the fourth transistor, and a second terminal that is electrically connected to the second power supply line; and from the capacitor part to the driving transistor, an electric current which turns on the driving transistor to prevent a hysteresis characteristic of the driving transistor from being initialized is flown before driving the light emitting element.

13. The pixel circuit as claimed in claim 12, wherein:

the first transistor is structured to selectively supply the data voltage that is supplied from the data line to the first terminal of the first capacitor;

the second transistor is structured to selectively supply a first power supply voltage that is supplied from the first power supply line to the first terminal of the third transistor, the second terminal of the first capacitor, and the second terminal of the second capacitor;

the third transistor is structured to selectively connect the second terminal of the first capacitor and the second terminal of the second capacitor to the first terminal of the fourth transistor;

the fourth transistor is structured to selectively connect the second terminal of the third transistor to the first terminal of the light emitting element; and the fifth transistor is structured to selectively supply a third power supply voltage which is supplied from the third power supply line to the first terminal of the first capacitor.

14. A pixel circuit driving method for driving a pixel circuit, comprising:

providing a pixel circuit, having at least a light emitting element, a driving transistor which supplies an electric current according to an applied voltage to the light emitting element, a capacitor part which holds a voltage containing a threshold voltage and a data voltage of the driving transistor and applies the voltage to the driving transistor, and a switch part which causes the capacitor part to hold the voltage containing the threshold voltage and the data voltage, the switch part including a reference voltage transistor which inputs a reference voltage from a reference voltage power supply line and a data voltage transistor which inputs the data voltage from a data line, and from the capacitor part to the driving transistor, an electric current which turns on the driving transistor to prevent a hysteresis characteristic of the driving transistor from being initialized is flown before driving the light emitting element;

and at the switch part:

initializing the voltage held to the capacitor part in the first period, turning on the reference voltage transistor to make the capacitor part hold the voltage containing the threshold voltage of the driving transistor in the second period after the first period, turning on the data voltage transistor to supply the data voltage to the capacitor part and make the capacitor part hold the voltage containing the threshold voltage and the data voltage in the third period after the second period, and supplying an electric current according to the data voltage to the light emitting element through applying the voltage held by the capacitor part to the driving transistor in the fourth period after the third period.

15. The pixel circuit driving method claimed in claim 14, wherein the second period is a time equal to or longer than one horizontal scanning period.

16. A pixel circuit driving method for driving a pixel circuit, comprising:

providing a pixel circuit, having at least a light emitting element, a driving transistor which supplies an electric current according to an applied voltage to the light emitting element, a capacitor part which holds a voltage containing a threshold voltage and a data voltage of the driving transistor and applies the voltage to the driving transistor, and a switch part which causes the capacitor part to hold the voltage containing the threshold voltage and the data voltage, the switch part including a reference voltage transistor which inputs a reference voltage from a reference voltage power supply line and a data voltage transistor which inputs the data voltage from a data line, and from the capacitor part to the driving transistor, an electric current which turns on the driving transistor to prevent a hysteresis characteristic of the driving transistor from being initialized is flown before driving the light emitting element, the driving transistor including a gate terminal, a source terminal, and a drain terminal, and supplies an electric current according to a voltage applied between the gate terminal and the source terminal to the light emitting element that is connected to the drain terminal, the capacitor part holding the voltage containing the threshold voltage and the data voltage of the driving transistor and applies the voltage between the gate terminal and the source terminal of the driving transistor, and the switch part including a plurality of transistors including the reference voltage transistor and the data voltage transistor, and causing the capacitor part to hold the voltage containing the threshold voltage and causing the capacitor part to hold the voltage containing the threshold voltage and the data voltage thereafter by switching operations of those transistors, the reference voltage supplied to the capacitor part through turning on the reference voltage transistor and turning off the data voltage transistor when making the capacitor part hold the voltage containing the threshold voltage, and the data voltage supplied to the capacitor part through turning off the reference voltage transistor and turning on the data voltage transistor when making the capacitor part hold the voltage containing the threshold voltage and the data voltage;

and at the switch part:

initializing the voltage held to the capacitor part in the first period, turning on the reference voltage transistor and turns off the data voltage transistor to make the capacitor part hold the voltage containing the threshold voltage of the driving transistor in the second period after the first period, turning off the reference voltage transistor and turns on the data voltage transistor to supply the data voltage to the capacitor part and make the capacitor part hold the voltage containing the threshold voltage and the data voltage in the third period after the second period, and supplying an electric current according to the data voltage to the light emitting element through applying the voltage held by the capacitor part between the gate terminal and the source terminal of the driving transistor in the fourth period after the third period.

17. A pixel circuit driving method for driving a pixel circuit, comprising:

providing a pixel circuit, having at least a light emitting element, a driving transistor which supplies an electric current according to an applied voltage to the light emitting element, a capacitor part which holds a voltage containing a threshold voltage and a data voltage of the driving transistor and applies the voltage to the driving transistor, and a switch part which causes the capacitor part to hold the voltage containing the threshold voltage and the data voltage, the switch part including a reference voltage transistor which inputs a reference voltage from a reference voltage power supply line and a data voltage transistor which inputs the data voltage from a data line, and from the capacitor part to the driving transistor, an electric current which turns on the driving transistor to prevent a hysteresis characteristic of the driving transistor from being initialized is flown before driving the light emitting element, the driving transistor including a gate terminal, a source terminal, and a drain terminal, and supplies an electric current according to a voltage applied between the gate terminal and the source terminal to the light emitting element that is connected to the drain terminal, the capacitor part holding the voltage containing the threshold voltage and the data voltage of the driving transistor and applies the voltage between the gate terminal and the source terminal of the driving transistor, and the switch part including a plurality of transistors including the reference voltage transistor and the data voltage transistor, and causing the capacitor part to hold the voltage containing the threshold voltage and causing the capacitor part to hold the voltage containing the threshold voltage and the data voltage thereafter by switching operations of those transistors, the reference voltage supplied to the capacitor part through turning on the reference voltage transistor and turning off the data voltage transistor when making the capacitor part hold the voltage containing the threshold voltage, and the data voltage supplied to the capacitor part through turning off the reference voltage transistor and turning on the data voltage transistor when making the capacitor part hold the voltage containing the threshold voltage and the data voltage, where the pixel circuit has first to fifth transistors, first and second capacitors, and the light emitting element, the pixel circuit being electrically connected to the data line, first to fourth control lines, and first to third power supply lines, and where the third power supply line corresponds to a reference voltage power supply line, the first, second, fourth, and fifth transistors constitute the switch part, the first transistor corresponds to the data voltage transistor, the fifth transistor corresponds to the reference voltage transistor, the third transistor corresponds to the driving transistor, and the first and second capacitors constitute the capacitor part, the first transistor includes a first terminal that is electrically connected to the data line, a second terminal, and a control terminal that is electrically connected to the first control line, the second transistor includes a first terminal that is electrically connected to the first power supply line, a second terminal, and a control terminal that is electrically connected to the second control line, the third transistor includes a first terminal that is electrically connected to the second terminal of the second transistor and corresponds to the source terminal, a second terminal which corresponds to the drain terminal, and a control terminal that is electrically connected to the second terminal of the first transistor and corresponds to the gate terminal, the fourth transistor includes a first terminal that is electrically connected to the second terminal of the third transistor, a second terminal, and a control terminal that is electrically connected to the third control line, the fifth transistor includes a first terminal that is electrically connected to the third power supply line, a second terminal that is electrically connected to the second terminal of the first transistor, and a control terminal that is electrically connected to the fourth control line, the first capacitor includes a first terminal that is electrically connected to the second terminal of the first transistor, and a second terminal that is electrically connected to the first terminal of the third transistor, the second capacitor includes a first terminal that is electrically connected to the third power supply line, and a second terminal that is electrically connected to the first terminal of the third transistor, and the light emitting element includes a first terminal that is electrically connected to the second terminal of the fourth transistor, and a second terminal that is electrically connected to the second power supply line;

in a first period, setting voltages of the first to fourth control lines so that the first transistor and the fourth transistor are turned off and the second transistor, the third transistor, and the fifth transistor are turned on;

in a second period after the first period, setting the voltages of the first to fourth control lines so that the first transistor and the second transistor are turned off and the third transistor, the fourth transistor, and the fifth transistor are turned on;

in a third period after the second period, setting the voltages of the first to fourth control lines so that the second transistor, the fourth transistor, and the fifth transistor are turned off, the first transistor and the third transistor are turned on, and the data voltage is supplied from the data line; and in a fourth period after the third period, setting the voltages of the first to fourth control lines so that the first transistor and the fifth transistor are turned off and the second, the third transistor, and the fourth transistor are turned on.

* * * * *